US009012117B2

(12) United States Patent
Nakajima et al.

(10) Patent No.: US 9,012,117 B2
(45) Date of Patent: Apr. 21, 2015

(54) TONER, DEVELOPER, TONER CONTAINER, PROCESS CARTRIDGE, IMAGE FORMING METHOD, AND IMAGE FORMING APPARATUS

(75) Inventors: Hisashi Nakajima, Shizuoka (JP); Shinya Nakayama, Shizuoka (JP); Saori Yamada, Shizuoka (JP); Hiroshi Yamashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 797 days.

(21) Appl. No.: 12/795,064

(22) Filed: Jun. 7, 2010

(65) Prior Publication Data

US 2010/0316944 A1 Dec. 16, 2010

(30) Foreign Application Priority Data

Jun. 10, 2009 (JP) ..... 2009-139395

(51) Int. Cl.
*G03G 9/087* (2006.01)
*G03G 21/18* (2006.01)
*G03G 9/08* (2006.01)

(52) U.S. Cl.
CPC ..... *G03G 21/1814* (2013.01); *G03G 9/0804* (2013.01); *G03G 9/0819* (2013.01); *G03G 9/0827* (2013.01); *G03G 9/08748* (2013.01); *G03G 9/08755* (2013.01); *G03G 9/08791* (2013.01)

(58) Field of Classification Search
CPC ..... G03G 9/0804; G03G 9/08755
USPC ..... 430/109.3–109.4, 111.3
See application file for complete search history.

(56) References Cited

U.S. PATENT DOCUMENTS

| | | | | |
|---|---|---|---|---|
| 7,713,672 | B2 | 5/2010 | Watanabe et al. | |
| 7,718,340 | B2 | 5/2010 | Iwamoto et al. | |
| 2006/0210903 | A1 * | 9/2006 | Ohki et al. | 430/109.4 |
| 2007/0248380 | A1 | 10/2007 | Iwamoto et al. | |
| 2007/0281237 | A1 * | 12/2007 | Iwamoto et al. | 430/123.5 |
| 2008/0118855 | A1 * | 5/2008 | Nakayama et al. | 430/109.4 |
| 2008/0261131 | A1 | 10/2008 | Nakayama et al. | |
| 2008/0280218 | A1 | 11/2008 | Sabu et al. | |

(Continued)

FOREIGN PATENT DOCUMENTS

| | | |
|---|---|---|
| JP | 4-70765 | 3/1992 |
| JP | 7-82254 | 9/1995 |

(Continued)

OTHER PUBLICATIONS

Office Action issued May 14, 2013 in Japanese Patent Application No. 2009-139395.

*Primary Examiner* — Peter Vajda
*Assistant Examiner* — Rashid Alam
(74) *Attorney, Agent, or Firm* — Oblon, McClelland, Maier & Neustadt, L.L.P.

(57) ABSTRACT

An electrostatic image developing toner including a resin fine particle, and a toner material containing a polyester-based resin, wherein the electrostatic image developing toner is obtained by dissolving and/or dispersing the toner material containing the polyester-based resin in an organic solvent to prepare a toner material liquid, and dispersing the toner material liquid in an aqueous solvent containing the resin fine particle, and wherein the polyester-based resin contains a polyester resin obtained by polycondensation of an alcohol component with a carboxylic acid component containing a modified purified-rosin.

19 Claims, 4 Drawing Sheets

(56) References Cited

U.S. PATENT DOCUMENTS

| | | | | |
|---|---|---|---|---|
| 2008/0280219 | A1 | 11/2008 | Nakayama et al. | |
| 2008/0286676 | A1* | 11/2008 | Yoshiba et al. | 430/106.2 |
| 2008/0318143 | A1 | 12/2008 | Nakayama et al. | |
| 2009/0103950 | A1 | 4/2009 | Nakayama et al. | |
| 2009/0117485 | A1* | 5/2009 | Kimura et al. | 430/109.4 |
| 2009/0170021 | A1* | 7/2009 | Kaya et al. | 430/109.4 |
| 2009/0175658 | A1 | 7/2009 | Iwamoto et al. | |
| 2009/0269692 | A1* | 10/2009 | Awamura et al. | 430/137.1 |
| 2010/0068644 | A1 | 3/2010 | Nakajima et al. | |
| 2010/0136471 | A1 | 6/2010 | Yamada et al. | |

FOREIGN PATENT DOCUMENTS

| | | | |
|---|---|---|---|
| JP | 2005-37901 | | 2/2005 |
| JP | 2007-47764 | | 2/2007 |
| JP | 2007-137910 | | 6/2007 |
| JP | 2007-292860 | | 11/2007 |
| JP | 2007-292869 | | 11/2007 |
| JP | 2007-292873 | | 11/2007 |
| JP | 2008-281882 | | 11/2008 |
| JP | 2008-281884 | | 11/2008 |
| JP | 2009-3116 | | 1/2009 |
| JP | 2009-3135 | | 1/2009 |
| WO | WO 2010/029903 | A1 | 3/2010 |

* cited by examiner

TONER, DEVELOPER, TONER CONTAINER, PROCESS CARTRIDGE, IMAGE FORMING METHOD, AND IMAGE FORMING APPARATUS

BACKGROUND OF THE INVENTION

1. Field of the Invention

The present invention relates to a toner for developing an electrostatic image in, for example, electrophotography, electrostatic recording, and electrostatic printing, and relates to a developer, a toner container, a process cartridge, an image forming method, and an image forming apparatus.

2. Description of the Related Art

In recent years, market demands for energy saving and higher-speed performance in image forming apparatuses such as printers, copiers, and facsimiles have been stronger. In keeping with this trend, in the field of electrophotographic toner (hereinbelow, otherwise referred to as "toner" for simplification) as well, while a toner excellent in low-temperature fixability is required, a toner having properties that work against low-temperature fixability, for example, offset resistance, heat resistant-storage stability (blocking resistance) and smear resistance on developer rollers etc., is also required.

To respond to these demands, the following toners have been proposed. Specifically, a toner which contains a linear polyester resin having defined physical properties such as molecular weight (for example, see Japanese Patent (JP-B) No. 3773906), a toner containing a non-linear crosslinked polyester resin in which rosins are used as an acid component (for example, see Japanese Patent Application Laid-Open (JP-A) No. 04-70765), a toner having improved fixability by using a rosin modified with a maleic acid (for example, see Japanese Patent Application Publication (JP-B) No. 07-82254), and a toner using, as a binder resin, a polyester composed of an alcohol component and a carboxylic acid component containing a (meth)acrylic acid-modified rosin (for example, see Japanese Patent Application Laid-Open (JP-A) Nos. 2007-292860 and 2007-292869). Also, there has been proposed a method of blending a low-molecular-weight resin and a high-molecular weight resin (for example, see Japanese Patent Application Laid-Open (JP-A) No. 2-82267).

With the recent market growth in the print-on-demand (POD) field, demands for toner have been increasing in the printing market. The POD technology utilizing an electrophotographic printing method is well suited for printing a small number of copies and for variable printing (printing of images or data varied for each paper sheet) and thus is expected as an alternative to low-volume printing technology. However, as there is a need for a super high-speed printing system that operates at a significantly faster printing speed than the conventional high-speed copiers, and compatibility with a wide variety of paper sheet types, there is new need for a toner capable of exhibiting excellent fixability even with a smaller amount of heat and causing less smear on developing rollers and the like.

As described above, in the field of print-on-demand (POD) using electrophotographic printing methods, there is need for a super high-speed printing system that operates at a significantly faster printing speed than the conventional high-speed copiers and that is compatible with a wide variety of paper sheet types. Therefore, the toner consumption rate is high, and it is undesirable to use a toner which is inferior in pulverizability and productivity, like toners containing a linear polyester resin having defined physical properties such as molecular weight, as seen in JP-B No. 3773906. Also, rosins used in JP-A No. 04-70765 and JP-B No. 07-82254 are effective in improving the low-temperature fixability, but have a drawback in that these toners are liable to generate odors depending on the type of rosin. Furthermore, toners disclosed in (JP-A) Nos. 2007-292860 and 2007-292869 use as a binder resin a polyester composed of an alcohol component and a carboxylic acid component containing a (meth)acrylic acid-modified rosin. These toners can exhibit excellent fixability on a wide variety of conventional type image forming apparatuses ranging from low-speed printing machines to high-speed printing machines. However, these toners fail to simultaneously satisfy the low-temperature fixability and smear resistance on a carrier and developing rollers and the like on super high-speed printing systems, and still remain inadequate to meet the above-mentioned demands in the print on demand (POD) field.

Conventionally, a so-called "pulverized toner" is widely used as a dry-process toner in, for example, electrophotography, electrostatic recording and electrostatic printing. Pulverized toner is a toner in which a toner binder (e.g. a styrene resin and a polyester resin) is melt-kneaded together with a colorant, and the melt-kneaded product is pulverized. Such a pulverized toner requires not only a large amount of energy consumption for melt-kneading and pulverization, but also requires a step of classifying pulverized toner particles so as not to widen its post-pulverization particle size distribution, further leading to a decrease in productivity. Amid demands for improving the low-temperature fixability of toner to respond to the recent demands for higher-speed performance and energy saving, the softening point of a resin is decreased and toner particles are excessively pulverized in pulverization processes, which leads to a new problem of low productivity of pulverized toner.

A pulverized toner is produced by melt-kneading and dispersing internal additives such as a colorant, a charge controlling agent and a releasing agent in a binder resin (for example, see Japanese Patent (JP-B) Nos. 2851895, and 3772910). However, in such a pulverization method, particles tend to be pulverized at the interface between the internal additives and the binder resin during pulverization process, causing nonuniformity between individual toner particles and nonuniformity over the surface of individual toner particles, which leads to degradation in the quality of toner. Even if such toner particles are subjected to classification, image quality may vary after repeating the developing process, because of the wide particle size distribution of the toner. This is because particles having particle diameters which are easily developed in the developing process exist in the toner particles. In a two-component developer using a carrier, toner particles having large particle diameters tend to be used in developing processes. Therefore, when a developing process is repeated, the diameter of toner in the developer is reduced to cause degradation in image density. Meanwhile, in a one-component developer, toner particles having small particle diameters are easily developed, and when a developing process is repeated, the particle diameter of toner in the developer becomes greater, which tends to cause degradation of the dot reproducibility and the middle toner reproducibility.

With solutions to the drawbacks associated with pulverized toners, recent interest has focused on a so-called polymerization toner produced by toner production methods such as suspension polymerization methods, emulsion polymerization aggregation methods, and polymer dissolution/suspension polymerization methods. In a toner produced by a polymerization method selected from the suspension polymerization method, emulsification polymerization method, and dissolution suspension method, a styrene-acrylic ester copolymer is generally used. As a toner using a polyester resin, there has been proposed to use a polyester modified with a urea bond for the purpose of improving the heat resistant storage stability and the low-temperature fixability (for example, see Japanese Patent (JP-B) No. 3762077), and to use a polyester which is produced by polycondensation of 1,2-propane diol with a carboxylic acid component containing a purified rosin (for example, see Japanese Patent Application Laid-Open (JP-A) No. 2008-281882). Concerning the use of polyester in toner, in the recent super high-speed printing systems using an electrophotographic printing method in the print-on-demand (POD) field, it is also desired to achieve improvements in the low-temperature fixability, and the offset resistance, heat resistant storage stability (blocking resistance) and smear resistance on developing rollers, which are properties opposite to the low-temperature fixability and to reduce the amount of odor that could be caused depending on the type of rosins.

BRIEF SUMMARY OF THE INVENTION

The present invention aims to solve the above-mentioned conventional problems and to achieve the following object. That is, the object of the present invention is to provide a toner which can achieve improvements in the low-temperature fixability, offset resistance and heat resistant storage stability on a level suitable for super high-speed printing systems and which can reduce the occurrence of odor, which is excellent in smear resistance on developing rollers in super high-speed printing systems as well as excellent in productivity; and to provide a developer using the toner, a toner container, a process cartridge, an electrophotographic image forming method and an image forming apparatus each using the toner.

By way of examples, features of the present invention, which are means for solving the above-mentioned problems, are as follow:

(1) A toner including:

a resin fine particle, and a toner material containing a polyester-based resin, wherein the electrostatic image developing toner is obtained by dissolving and/or dispersing the toner material containing the polyester-based resin in an organic solvent to prepare a toner material liquid, and dispersing the toner material liquid in an aqueous solvent containing the resin fine particle, and wherein the polyester-based resin contains a polyester resin obtained by polycondensation of an alcohol component with a carboxylic acid component containing a modified purified-rosin.

(2) The toner according to (1), wherein the alcohol component contains 1,2-propanediol in an amount of 65 mol % or more in a dihydric alcohol component.

(3) The toner according to one of (1) and (2), wherein the modified purified-rosin is a purified rosin which is modified with at least one of an acrylic acid, a fumaric acid and a maleic acid.

(4) The toner according to any one of (1) to (3), wherein part of the polyester-based resin in a composition containing the polyester-based resin is a functional group-containing-polyester-based resin; and the toner is formed of a dispersion liquid which is obtained by dispersing a phase of the organic solvent in which the polyester-based resin has been dissolved, an active hydrogen containing compound and a colorant in an aqueous medium in which the resin fine particle has been dispersed to effect an elongation reaction and/or a crosslinking reaction of the functional group-containing-polyester-based resin with the active hydrogen containing compound.

(5) The toner according to any one of (1) to (4), wherein the degree of circularity of the toner is in the range of 0.94 to 0.98.

(6) The toner according to (1) to (5), wherein the volume average particle diameter of the toner is 3 μm to 8 μm.

(7) The toner according to any one of (1) to (6), wherein a ratio (Dv/Dn) of the volume average particle diameter (Dv) to a number average particle diameter (Dn) of the toner is 1.25 or less.

(8) A two-component developer including:

the toner according to any one of (1) to (7), and a carrier which comprises magnetic particles.

(9) A toner container, wherein the toner container houses the toner according to any one of (1) to 7).

(10) A process cartridge including:

a latent electrostatic image bearing member, and a developing unit configured to develop a latent electrostatic image formed on the latent electrostatic image bearing member using a toner to form a visible image, wherein the process cartridge is detachably mounted to a main body of an image forming apparatus, wherein the toner is the toner according to any one of (1) to (7).

(11) An image forming method including:

forming a latent electrostatic image on a latent electrostatic image bearing member, developing the latent electrostatic image using a toner to form a visible image, transferring the visible image onto a recording medium, and fixing the transferred image on the recording medium, wherein the toner is the toner according to any one of (1) to (7).

(12) An image forming apparatus including:

an electrophotographic photoconductor, a charging unit configured to charge a surface of the electrophotographic photoconductor, an exposing unit configured to expose the charged surface of the electrophotographic photoconductor to form a latent electrostatic image on the electrophotographic photoconductor, a developing unit configured to develop the latent electrostatic image formed on the electrophotographic photoconductor using a toner to visualize the latent electrostatic image and form a toner image, a transfer unit configured to transfer the toner image formed on the electrophotographic photoconductor directly or via an intermediate transfer member onto a recording material, and a fixing unit configured to fix the transferred toner image on the recording material, wherein the toner is the toner according to any one of (1) to (7).

According to the present invention, it is possible to provide a toner which can simultaneously satisfy the low-temperature fixability, offset resistance and heat resistant storage stability on a level suitable for super high-speed printing systems and which can reduce the occurrence of odor, is excellent in smear resistance on developing rollers in super high-speed printing systems as well as excellent in productivity; a developer using the toner; and a toner container, a process cartridge, an electrophotographic image forming method and an image forming apparatus each using the toner.

DETAILED DESCRIPTION OF THE INVENTION

Figure 1:
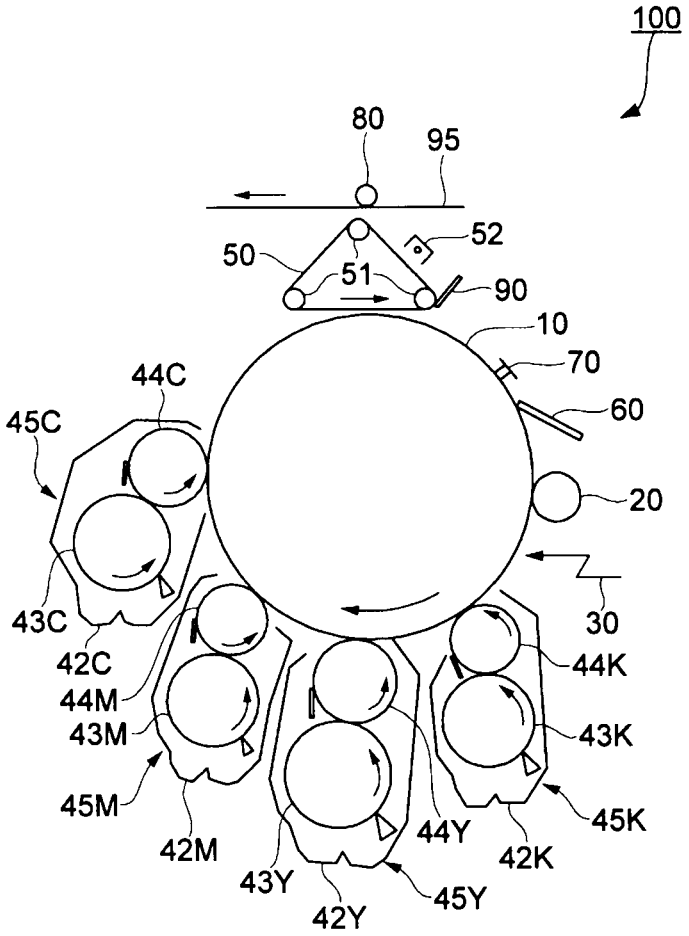
FIG. 1 is a diagram illustrating one example of an image forming apparatus according to the present invention.

Hereinafter, the present invention will be described in detail with reference to embodiments for carrying out the present invention.

(Toner)

A toner according to a first embodiment of the present invention is produced according to the following procedure: a toner material containing a polyester-based resin is dissolved and/or dispersed in an organic solvent to prepare a toner material liquid, the toner material liquid containing the polyester-based resin is dispersed in an aqueous solvent containing a resin fine particle so as to be emulsified and granulated in the aqueous solvent, and the solvents are removed from the resulting emulsified dispersion liquid, followed by washing/desorbing resin particles adhered on a surface of a toner. The polyester-based resin contains a polyester resin obtained by polycondensation of an alcohol component with a carboxylic acid component containing a modified purified rosin.

A toner according to a second embodiment of the present invention is produced according to the following procedure: a toner material containing a polyester-based resin and a polyester-based resin precursor is dispersed in an organic solvent to prepare a toner material liquid, the toner material liquid is dispersed in an aqueous solvent containing a resin fine particle so as to be emulsified and granulated in the aqueous solvent, the polyester-based resin precursor is subjected to a reaction to prepare an emulsified dispersion liquid, and the solvents in the emulsified dispersion liquid, followed by washing/desorbing resin particles adhered on a surface of a toner. The polyester-based resin and the polyester-based resin precursor contain a polyester resin obtained by polycondensation of an alcohol component with a carboxylic acid.

Note that the toner material may contain, the after-mentioned colorant, releasing agent, charge controlling agent and the like, in addition to the polyester-based resin or the polyester-based resin and the polyester-based resin precursor.

<Resin Fine Particle Forming Aqueous Dispersion Liquid>

In the present invention, a resin constituting the resin fine particle is not particularly limited, as long as it is a resin capable of forming an aqueous dispersion liquid, and may be a thermoplastic resin or may be a thermosetting resin. Examples of the resin include a vinyl-based resin, polyurethane resin, epoxy resin, polyester resin, polyamide resin, polyimide resin, silicon-based resin, phenol resin, melamine resin, urea resin, aniline resin, ionomer resin, and polycarbonate resin. As the resin constituting the resin fine particle, the above-mentioned resins may be used alone or in combination. Among these, preferred are a vinyl-based resin, a polyurethane resin, an epoxy resin, a polyester resin and a combination thereof.

The following describes the vinyl resin, polyurethane resin and epoxy resin, but resins other than those described below can be used in the present invention.

Particularly preferred examples of the resin constituting the resin fine particle include vinyl-based resins. More specifically, a polymer obtained by monopolymerization or copolymerization of a vinyl-based monomer can be used. In the (co)polymerization, a known polymerization catalyst and the like can be used.

As a vinyl-based monomer, the following monomers (1) to (10) are exemplified:

(1) Vinyl Hydrocarbon:

(1-1) Aliphatic Vinyl Hydrocarbons Described Below:

Hydrocarbon having a monovalent vinyl group, such as an alkene having 2 to 12 carbon atoms (e.g. ethylene, propylene, butene, isobutylene, pentene, heptene, diisobutylene, octene, dodecene, octadecene, α-olefin having 3 to 24 carbon atoms, etc.); and hydrocarbon having a divalent vinyl group, such as an alkadiene having 4 to 12 carbon atoms (e.g. butadiene, isoprene, 1,4-pentadiene, 1,6-hexadiene, etc.).

(1-2) Alicyclic Vinyl Hydrocarbon:

Cycloalkene or dicycloalkene each having 6 to 15 carbon atoms (e.g. cyclohexene, vinylcyclohexene, ethylidenebicycloheptene, etc.); cycloalkadiene or bicycloalkadiene each having 5 to 12 carbon atoms (e.g. (di)cyclopentadiene, etc.); and terpene (e.g. pinene, limonene, indene, etc.) and the like.

(1-3) Aromatic Vinyl Hydrocarbon:

Styrenes, hydrocarbyl (alkyl, cycloalkyl, aralkyl and/or alkenyl group having 1 to 24 carbon atoms) substituents of styrenes (e.g. α-methylstyrene, vinyltoluene, 2,4-dimethylstyrene, ethylstyrene, butylstyrene, phenylstyrene, cyclohexylstyrene, benzylstyrene, crotylbenzene, divinylbenzene, etc.); and vinyl naphthalene, and the like.

(2) Vinyl Monomer Containing a Carboxyl Group, and Salts Thereof:

Unsaturated monocarboxylic acids {e.g. (meth)acrylic acids (acrylic acid and/or methacrylic acid), the same applied to those described below) having 3 to 30 carbon atoms, crotonic acid, isocrotonic acid, cinnamic acid, etc.}; dicarboxylic acids having 3 to 30 carbon atoms or anhydrides thereof (e.g. maleic acid (anhydrides), fumaric acid, itaconic acid, citraconic acid (anhydrides), mesaconic acid, etc.); monoalkyl (having 1 to 24 carbon atoms) esters of unsaturated dicarboxylic acids having 3 to 30 carbon atoms (e.g. monomethyl maleate, monooctadecyl maleate, monomethyl fumarate, monobutyl itaconate, etc.).

Specific examples of salts of vinyl monomer containing a carboxyl group include, but are not limited to, salts of vinyl monomers having a carboxyl group, such as, alkali metal salts (sodium salt, potassium salt, etc.); alkali earth metal salts (calcium salt, magnesium salt, etc.); ammonium salt, amine salt, and quaternary ammonium salt. The amine salt is not particularly limited as long as it is an amine compound. Specific examples of the amine salt include primary amine salts (ethyl amine salt, butyl amine salt, octyl amine salt, etc.); secondary amine salts (diethyl amine salt, dibutylamine salt, etc.); tertiary amine salts (triethyl amine salt, tributylamine salt, etc.); and quaternary ammonium salts (tetraethyl ammonium salt, and triethyllaurylammonium salt, etc.).

Specific examples of salts of vinyl monomer containing a carboxyl group include sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, and aluminum acrylate.

(3) Vinyl Monomer Containing a Sulfo Group and Salts Thereof:

Alkene sulfonic acids having 2 to 14 carbon atoms (e.g. vinyl sulfonic acid, (meth)aryl sulfonic acid, methyl vinyl sulfonic acid, etc.); styrene sulfonic acids and alkyl (having 2 to 24 carbon atoms) derivatives (e.g. α-methylstyrene sulfonic acid, etc.); sulfo(hydroxy)alkyl(meth)acrylate having 5 to 18 carbon atoms (e.g. sulfopropyl(meth)acrylate, 2-hydroxy-3-(meth)acryloxy propyl sulfonic acid, etc.); sulfo(hydroxy)alkyl(meth)acrylamide having 5 to 18 carbon atoms (e.g. 2-(meth)acryloylamino-2,2-dimethylethane sulfonic acid, 2-(meth)acrylamide-2-methylpropane sulfonic acid); alkyl (having 3 to 18 carbon atoms) allyl sulfosuccinic acid (e.g. propylallylsulfosuccinic acid, and butylallylsulfosuccinic acid); poly(n=2 to 30)oxyalkylene(oxyethylene, oxypropylene, oxybutylene; sulfates of mono(meth)acrylate that may be singular, random or blocked) (e.g. poly (n=5 to 15) oxyethylene monomethacrylate sulfate); and compounds represented by any one of the following General Formulae (3-1) to (3-3) or salts thereof.

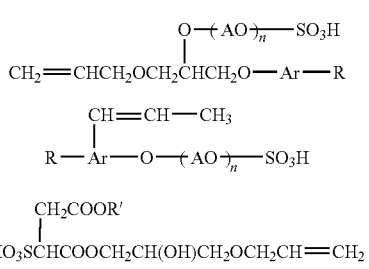

(3-1)

(3-2)

(3-3)

(where R represents an alkyl group having 1 to 15 carbon atoms; A represents an alkylene group having 2 to 4 carbon atoms, when n is plural, As are may be identical to or different from each other, and when As are different from each other, each of As is random, blocked and/or a mixture thereof; Ar represents a benzene ring; n is an integer of 1 to 50; and R' represents an alkyl group having 1 to 15 carbon atoms which may be substituted by a fluorine atom.)

Note that as the salts, counter ions to those described in (2) Vinyl monomer containing a carboxyl group and salts thereof can be used.

(4) Vinyl Monomer Containing a Phosphono Group and Salts Thereof:

(Meth)acryloyloxyalkyl monophosphate (the number of carbon atoms of the alkyl group: 1 to 24) (e.g. 2-hydroxyethyl (meth)acryloylphosphate, phenyl-2-acryloyloxyethylphosphate, etc.), (meth)acryloyloxyalkyl phosphonic acid (the number of carbon atoms of the alkyl group: 1 to 24) (e.g. 2-acryloyloxyethyl phosphonic acid, etc.).

Note that as the salts, counter ions to those described in (2) Vinyl monomer containing a carboxyl group and salts thereof can be used.

(5) Vinyl Monomer Containing a Hydroxyl Group:

Hydroxystyrene, N-methylol(meth)acrylamide, hydroxyethyl(meth)acrylate, hydroxypropyl(meth)acrylate, polyethylene glycol mono(meth)acrylate, (meth)allylalcohol, crotyl alcohol, isocrotyl alcohol, 1-buten-3-ol, propargyl alcohol, 2-hydroxyethyl propenyl ether, and sucrose allyl ether, etc.

(6) Nitrogen-Containing Vinyl Monomer:

(6-1) Vinyl Monomer Containing an Amino Group:

Aminoethyl(meth)acrylate, dimethylaminoethyl(meth) acrylate, diethylaminoethyl(meth)acrylate, t-butylaminoethyl methacrylate, N-aminoethyl(meth)acrylamide, (meth)allylamine, morpholinoethyl(meth)acrylate, 4-vinylpyridine, 2-vinylpyridine, crotylamine, N,N-dimethylaminostyrene, methyl α-acetoaminoacrylate, vinyl imidazole, N-vinyl pyrrole, N-vinylthiopyrrolidone, N-arylphenylenediamine, amino carbazole, salts thereof, etc.

(6-2) Vinyl Monomer Containing an Amide Group:

(meth)acrylamide, N-methyl(meth)acrylamide, N-butyl acrylamide, diacetone acrylamide, N-methylol(meth)acrylamide, N,N'-methylene bis(meth)acrylamide, cinnamic acid amide, N,N-dimethyl acrylamide, etc.

(6-3) Vinyl Monomer Containing a Nitryl Group Having 3 to 10 Carbon Atoms:

(Meth)acrylonitrile, cyanostyrene, cyanoacrylate, etc.

(6-4) Vinyl Monomer Containing a Group of a Quaternary Ammonium Cation:

Quaternalized products (quaternarized products obtained by using a quaternarizing agent, of methyl chloride, dimethyl sulfate, and benzyl chloride, for example, dimethyldiallylammonium chloride, trimethylallylammonium chloride, etc.) of vinyl monomers having a tertiary amino group such as dimethylaminoethyl(meth)acrylate, diethylaminoethyl(meth) acrylate, dimethylaminoethyl(meth)acrylamide, diethylaminoethyl(meth)acrylamide, and the like.

(6-5) Vinyl Monomer Containing a Nitro Group Having 8 to 12 Carbon Atoms:

Nitrostyrenes, etc.

(7) Vinyl Monomer Containing an Epoxy Group Having 6 to 18 Carbon Atoms:

Glycidyl(meth)acrylate, tetrahydrofuryl(meth)acrylate, p-vinylphenylphenyl oxide, etc.

(8) Vinyl Monomer Containing a Halogen Group Having 2 to 16 Carbon Atoms:

Vinyl chloride, vinyl bromide, vinylidene chloride, allyl chloride, chlorostyrene, bromostyrene, dichlorostyrene, chloromethylstyrene, tetrafluorostyrene, chloroprene, etc.

(9) Vinyl Ester, Vinyl(Thio)Ether, Vinyl Ketone, Vinyl Sulfone:

(9-1) Vinyl Ester Having 4 to 16 Carbon Atoms:

Vinyl acetate, vinyl propionate, vinyl butyrate, diallyl phthalate, diallyl adipate, isopropenyl acetate, vinyl methacrylate, cyclohexyl methacrylate, benzyl methacrylate, phenyl(meth)acrylate, vinyl methoxy acetate, vinyl benzoate, alkyl(meth)acrylate containing an alkyl group having 1 to 50 carbon atoms (methyl(meth)acrylate, ethyl(meth)acrylate, butyl(meth)acrylate, dodecyl(meth)acrylate, heptadecyl (meth)acrylate, etc.), dialkyl fumarate (two alkyl groups are linear, branched or alicyclic groups having 2 to 8 carbon atoms), dialkyl maleate (two alkyl groups are linear, branched or alicyclic groups having 2 to 8 carbon atoms), poly(meth) allyl oxyalkanes (diallyloxyethane, triallyloxyethane, tetraallyloxypropane, etc.) and the like; vinyl monomers having polyalkylene glycol chains (polyethylene glycol (molecular weight: 300) mono(meth)acrylate, polypropylene glycol (molecular weight: 500) monoacrylate, methyl alcohol ethylene oxide (hereinbelow, ethylene oxide is described as EO) (10 mol) adduct (meth)acrylate, lauryl alcohol EO (30 mol) adduct (meth)acrylate, etc.), poly(meth)acrylates (poly (meth)acrylates of polyhydric alcohols: ethylene glycol di(meth)acrylate, propylene glycol di(meth)acrylate, polyethylene glycol di(meth)acrylate, etc.), and the like.

(9-2) Vinyl(Thio)Ether Having 3 to 16 Carbon Atoms:

Vinyl methyl ether, vinyl ethyl ether, vinyl butyl ether, vinyl 2-ethylhexyl ether, vinyl phenyl ether, vinyl 2-methoxy ethyl ether, methoxy butadiene, phenoxy styrene, etc.

(9-3) Vinyl Ketone Having 4 to 12 Carbon Atoms:

Vinyl methyl ketone, vinyl ethyl ketone, vinyl phenyl ketone, etc.

(9-4) Vinyl Sulfone Having 2 to 16 Carbon Atoms:

Divinyl sulfide, p-vinyl phenyl sulfide, vinyl ethyl sulfide, vinyl ethyl sulfone, divinyl sulfone, divinyl sulfoxide, etc.

(10) Other Vinyl Monomers:

Isocyanatoethyl(meth)acrylate, misopropenyl-α,α-dimethyl benzylisocyanate, etc.

Among vinyl resins, as a polymer produced by copolymerization of vinyl monomers (a copolymer of vinyl monomers), a polymer obtained by copolymerizing two or more monomers selected from the above-mentioned vinyl monomers (1) to (10) in an arbitrary ratio can be used. Specific examples of the copolymer of vinyl monomers include a styrene-(meth) acrylate copolymer, a styrene-butadiene copolymer, a (meth) acrylic acid-(meth)acrylate copolymer, a styrene-acrylonitrile copolymer, a styrene-maleic (anhydride) copolymer, a styrene-(meth)acrylic acid copolymer, a styrene-(meth) acrylic acid-divinylbenzene copolymer, and a styrene-styrenesulfonic acid-(meth)acrylate copolymer.

<<Resin Fine Particle Forming Aqueous Dispersion Liquid Suitable for Dissolution Suspension Method>>

When a toner is produced using a dissolution suspension method, a resin constituting resin particles needs to form the resin particles in an aqueous resin dispersion. Therefore, the resin is at least required not to be completely dissolved in water under conditions for forming an aqueous dispersion for toner (usually, at a temperature of 5° C. to 90° C.). For this reason, when the vinyl-based resin is a copolymer, the proportion of a hydrophobic monomer and a hydrophilic monomer which constitute a vinyl monomer depends on the type of monomers selected, however, generally, the proportion of a hydrophobic monomer is preferably 10% or more, more preferably 30% or more. When the proportion of the hydrophobic monomer is less than 10%, the resulting vinyl-based resin tends to be too water-soluble, which may cause degradation of uniformity of toner particle size. Note that in the descriptions hereinabove and hereinbelow, "%" means "% by weight" unless otherwise referred to separately.

Here, the term "a hydrophilic monomer" means a monomer which is dissolved in an amount of 100 g or more in 100 g of water (25° C.); and the term "a hydrophobic monomer" means a monomer other than monomers described above as hydrophilic monomers, i.e, a monomer which is not dissolved in an amount of 100 g or more in 100 g of water (25° C.)) (the same applies to the resins described below).

As a polyester resin, there may be exemplified polycondensates of polyol, polycarboxylic acid with an acid anhydride thereof or a lower alkylester thereof, and addition polymers of the after-mentioned alcohol (m) with a cyclic ester (n).

As the polyol, diols (11) and trihydric to octahydric or nonahydric polyols or higher polyhydric polyols (12) are used.

As the polycarboxylic acid, acid anhydride thereof, lower alkyl ester thereof, dicarboxylic acids (β) and trivalent to hexavalent or heptavalent or higher polycarboxylic acid (14), acid anhydrides thereof, lower alkyl esters thereof are used.

The ratio of a polyol to a polycarboxylic acid in the polycondensation is, in terms of an equivalent ratio [OH]/[COOH] of the hydroxyl groups [OH] of the polyol to the carboxyl groups [COOH] of the polycarboxylic acid, preferably 2/1 to 1/1, more preferably 1.5/1 to 1/1, particularly preferably 1.3/1 to 1.02/1.

Examples of the diols (11) include alkylene glycols having 2 to 30 carbon atoms (e.g. ethylene glycol, 1,2-propylene glycol, 1,3-propylene glycol, 1,4-butanediol, 1,6-hexanediol, octanediol, decanediol, dodecanediol, tetradecanediol, neopentyl glycol, 2,2-diethyl-1,3-propanediol, etc.); alkylene glycol ether having a molecular weight of 106 to 10,000 (e.g. diethylene glycol, triethylene glycol, dipropylene glycol, polyethylene glycol, polypropylene glycol, polytetramethylene ether glycol, etc.); alicyclic diols having 6 to 24 carbon atoms (e.g. 1,4-cyclohexane dimethanol, hydrogenated bisphenol A, etc.); alkylene oxides of the above-mentioned alicyclic diols having a molecular weight of 100 to 10,000 (alkylene oxides: referred to as "AO" hereinafter) (ethylene oxide, propylene oxide, butylene oxide (which are referred to as EO, PO, and BO, respectively) etc.) adducts (the number of addition moles: 2 to 100) (e.g. EO (10 mol) adduct of 1,4-cyclohexane dimethanol, etc.); bisphenols having 15 to 30 carbon atoms (bisphenol A, bisphenol F, bisphenol S, etc.) or AO (EO, PO, BO, etc.) adducts (the number of addition moles: 2 to 100) of polyphenols having 12 to 24 carbon atoms (e.g. catechol, hydroquinone, resorcin, etc.) (e.g. EO (2 to 4 mol) adduct of bisphenol A, PO (2 to 4 mol) adduct of bisphenol A, etc.), polylactonediols having a molecular weight of 100 to 5,000 (e.g. poly(ε-caprolactonediol) etc.); and polybutanediols having a Mw of 1,000 to 20,000, etc. (Mw: mass average molecular weight measured by GPC (Gel Permeation Chromatography).

Among these, preferred are AO adducts of alkylene glycol with bisphenols, with mixtures of AO adducts of bisphenols with alkylene glycol being more preferred.

Examples of the trihydric to octahydric or nonahydric polyols or higher polyhydric polyols (12) include aliphatic polyhydric alcohols having 3 to 8 carbon atoms (e.g. glycerin, trimethylolethane, trimethylolpropane, pentaerithritol, sorbitan, sorbitol, etc.); AO (C2 to C4) adducts (the number of addition moles: 2 to 100) of trisphenols having 25 to 50 carbon atoms (e.g. trisphenol PA) (e.g. EO (2 to 4 mol) adduct of trisphenol PA, PO (2 to 4 mol) adducts of trisphenol PA, etc.); AO (C2 to C4) adducts (the number of addition moles: 2 to 100) of novolac resins having a polymerization degree of 3 to 50 (e.g. phenol novolac, cresol novolac, etc.) (e.g. PO (2 mol) adduct of phenol novolac, EO (4 mol) adduct of phenol novolac, etc.); AO (C2 to C4) adducts (the number of addition moles: 2 to 100) of polyphenols having 6 to 30 carbon atoms (pyrogallol, phloroglucinol, 1,2,4-benzenetriol, etc.) (e.g. EO (4 mol) adduct of pyrogallol, etc.); and acrylic polyols having a polymerization degree of 20 to 2,000 (copolymers of hydroxyethyl(meth)acrylate with other vinyl monomer (e.g. styrene, (meth)acrylic acid, (meth)acrylate, etc.).

Among these, preferred are aliphatic polyhydric alcohols, and AO adducts of novolac resins, with AO adducts of novolac resins being more preferred.

Examples of the dicarboxylic acids (β) include alkane dicarboxylic acids having 4 to 32 carbon atoms (e.g. succinic acid, adipic acid, sebacic acid, azelaic acid, dodecane-dicarboxylic acid, octadecane-dicarboxylic acid, etc.); alkenedicarboxylic acids having 4 to 32 carbon atoms (e.g. maleic acid, fumaric acid, citraconic acid, mesaconic acid, etc.); branched alkenedicarboxylic acids having 8 to 40 carbon atoms (e.g. dimer acid, alkenyl succinic acid (dodecenyl succinic acid, pentadecenyl succinic acid, octadecenyl succinic acid, etc.)); branched alkane dicarboxylic acids having 12 to 40 carbon atoms (e.g. alkyl succinic acids (decyl succinic acid, dodecyl succinic acid, octadecyl succinic acid, etc.); and aromatic dicarboxylic acids having 8 to 20 carbon atoms (e.g. phthalic acid, isophthalic acid, terephthalic acid, naphthalene dicarboxylic acid, etc.).

Among these, preferred are alkene dicarboxylic acids, and aromatic dicarboxylic acids, with aromatic dicarboxylic acids being more preferred.

Examples of the trivalent to hexavalent or heptavalent or higher polycarboxylic acids (14) include aromatic polycarboxylic acids having 9 to 20 carbon atoms (e.g. trimellitic acid, pyromellitic acid, etc.), and the like.

Examples of the acid anhydrides of the dicarboxylic acids (β) and the trivalent to hexavalent or heptavalent or higher polycarboxylic acid (14) include trimellitic anhydrides, and pyromellitic anhydrides. Examples of the lower alkyl esters thereof include methyl esters, ethyl esters, and isopropyl esters.

Examples of the polyurethane resins include polyaddition products of a polyisocyanate (15) with a compound (D) having an active hydrogen group (e.g. water, diols (11), trihydric to octahydric or nonahydric polyols or higher polyhydric polyols (12), dicarboxylic acids (β), trivalent to hexavalent or heptavalent or higher polycarboxylic acids (14), polyamines (16), polythiols (17), etc.).

In the polyaddition reaction, a known polyaddition reaction catalyst can be used.

Examples of usable polyisocyanate (15) include aromatic polyisocyanates having 6 to 20 carbon atoms (excluding carbons in NCO groups, the same applied to the description below), aliphatic polyisocyanates having 2 to 18 carbon atoms, alicyclic polyisocyanates having 4 to 15 carbon atoms, aromatic-aliphatic polyisocyanates having 8 to 15 carbon atoms, modified products of these polyisocyanates (modified products having a urethane group, carbodiimide group, allophanate group, urea group, biuret group, urethodione group, urethoimine group, isocyanurate group or oxazolidone group, etc.), mixtures thereof.

Examples of the aromatic polyisocyanate include 1,3- or 1,4-phenylene diisocyanate, 2,4- or 2,6-trilene diisocyanate (TDI), crude TDI, 2,4'- or 4,4'-diphenylmethane diisocyanate (MDI), crude MDI (crude di(aminophenyl)methane(polycondensates of formaldehyde with aromatic amine (aniline) or a mixture thereof; phosgenated products of a mixture between di(aminophenyl)methane and a small amount (e.g. 5% to 20%) of trifunctional or higher functional polyamine): polyallyl polyisocyanate (PAPI)), 1,5-naphthylenediisocyanate, 4,4',4"-triphenylmethane triisocyanate, m- or p-isocyanatophenylsulfonyl isocyanate, and mixtures thereof.

Examples of the aliphatic polyisocyanates include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, 2-isocyanatoethyl-2,6-diisocyanatohexanoate, and mixtures thereof.

Examples of the alicyclic polyisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, and mixtures thereof.

Examples of the aromatic-aliphatic polyisocyanates include m- or p-xylylene diisocyanate (XDI), α,α,α,α'-tetramethylxylylene diisocyanate (TMXDI), and mixtures thereof.

As for the modified product of polyisocyanate, a modified product containing a urethane group, carbodiimide group, allophanate group, urea group, biuret group, urethodione group, urethoimine group, isocyanurate group and/or oxazolidone group is used. Examples of the modified product include modified MDI (urethane modified MDI, carbodiimide modified MDI, trihydrocarbyl phosphate modified MDI, etc.), urethane modified TDI, and mixtures thereof (e.g. a mixture of a modified MDI with a urethane modified TDI (prepolymer having an isocyanate group).

Among these, preferred are aromatic polyisocyanates, aliphatic polyisocyanates, and alicyclic polyisocyanates, with TDI, MDI, HDI, hydrogenated MDI and hydrogenated IPDI being more preferred.

As for the polyamine (16), an aliphatic polyamines having 2 to 18 carbon atoms, and an aromatic polyamine having 6 to 20 carbon atoms can be used.

As for the aliphatic polyamine having 2 to 18 carbon atoms, aliphatic polyamine, an alkyl (C1 to C4) substituent or hydroxyalkyl (C2 to C4) substituent of aliphatic polyamine, alicyclic polyamine or aliphatic polyamine having a heterocyclic ring, and aliphatic polyamine (C8 to C15) having an aromatic ring can be used.

Examples of aliphatic polyamine include alkylene diamine having 2 to 12 carbon atoms (ethylene diamine, propylene diamine, trimethylene diamine, tetramethylene diamine, hexamethylene diamine, etc.), polyalkylene (C2 to C6), polyamine (diethylene triamine, iminobis-propylamine, bis(hexamethylene)triamine, triethylene tetramine, and pentaethylene hexamine, etc.).

Examples of the alkyl (C1 to C4) substituent or hydroxyalkyl (C2 to C4) substituent of aliphatic polyamine include dialkyl (C1 to C3) amino propyl amine, trimethylhexamethylene diamine, amino ethyl ethanol amine, 2,5-dimethyl-2,5-hexamethylene diamine, methylimino-bis-propyl amine.

Examples of the alicyclic polyamine or aliphatic polyamine having a heterocyclic ring include alicyclic polyamines having 4 to 15 carbon atoms (1,3-diaminocyclohexane, isophorone diamine, mensenediamine, 4,4'-methylenedicyclohexane diamine (hydrogenated methylene dianiline), 3,9-bis(3-aminopropyl)-2,4,8,10-tetraoxaspiro[5,5]undecane, etc.), and heterocyclic polyamines having 4 to 15 carbon atoms (piperazine, N-aminoethyl piperazine, 1,4-diaminoethyl piperazine, 1,4-bis(2-amino-2-methylpropyl) piperazine, etc.).

Examples of the aliphatic polyamine (C8 to C15) having an aromatic ring include xylylene diamine, and tetrachloro-p-xylylene diamine.

Examples of the aromatic polyamine (C6 to C20) usable in the present invention include unsubstituted aromatic polyamines, aromatic polyamines having a nuclear substituted alkyl group (an alkyl group having 1 to 4 carbon atoms, such as methyl group, ethyl group, n- or i-propyl group, and butyl group), aromatic polyamines having a nuclear-substituted electron attractive group (a halogen group such as chloro group, bromo group, iodine group, fluoro group; alkoxy group such as methoxy group, ethoxy group; nitro group, etc.), and aromatic polyamines having a secondary amino group.

Examples of the unsubstituted aromatic polyamines include 1,2-, 1,3- or 1,4-phenylenediamine, 2,4'- or 4,4'-diphenylmethanediamine, crude diphenylmethane diamine (polyphenyl polymethylene polyamine), diaminodiphenyl sulfone, benzidine, thiodianiline, bis(3,4-diaminophenyl)sulfone, 2,6-diamino pyridine, m-aminobenzylamine, triphenylmethane-4,4',4"-triamine, naphthylene diamine, and mixtures thereof.

Examples of the aromatic polyamines having a nuclear substituted alkyl group include 2,4- or 2,6-tolylenediamine, crude tolylenediamine, diethyl tolylenediamine, 4,4'-diamino-3,3'-dimethyldiphenylmethane, 4,4'-bis(o-toluidine), dianisidine, 1,3-dimethyl-2,4-diaminobenzene, and mixtures thereof.

Examples of the aromatic polyamines having a nuclear-substituted electron attractive group include methylenebis(o-chloroaniline), 4-chloro-o-phenylenediamine, 2-chloro-1,4-phenylenediamine, 3-amino-4-chloroaniline, and 4-bromo-1,3-phenylenediamine.

Examples of the aromatic polyamines having a secondary amino group include polyamines in which a part of or whole of a primary amino group of the above-mentioned aromatic polyamines is substituted by a secondary amino group represented by general formula —NHR'(R' represents an alkyl group, for example, a lower alkyl group having 1 to 4 carbon atoms, such as methyl group and ethyl group) (e.g. 4,4'-di(methylamino)diphenyl methane, 1-methyl-2-methylamine-4-aminobenzene, etc.), polyamide polyamines (e.g. low-molecular-weight polyamide polyamine obtainable by condensation of a dicarboxylic acid (dimer acid, etc.) with an excessive amount (2 moles or more per 1 mole of carboxylic acid) of polyamine (alkylene diamine, polyalkylene polyamine, etc.), polyether polyamine (hydrogenated compounds of cyanoethylated product (polyether polyol (polyalkylene glycol, etc.)).

As the polythiols (17), dithiols having 2 to 24 carbon atoms, and trivalent to hexavalent or heptavalent or higher having 5 to 30 carbon atoms may be used.

Examples of the dithiols include ethylene dithiols, 1,4-butanedithiol, and 1,6-hexanedithiol.

Specific examples of the polythiol include CUPCURE 3800 (produced by Japan Epoxy Resin Co., Ltd.), and polyvinyl thiols.

Among the compound (D) having an active hydroxyl group, preferred are water, diol (11), polyol (12), dicarboxylic acid (β), and polyamine (16); with water, diol (11), polyol (12) and polyamine (16) being more preferred, with diol (11), polyol (12) and polyamine (16) being particularly preferred.

As the epoxy resin, there may be exemplified ring-opened polymers of polyepoxide (18), polyaddition products of polyepoxide (18) with the compound (D) having an active hydrogen group (water, diol (11), trivalent or higher polyol (12), dicarboxylic acid (β), trivalent or higher polycarboxylic acid (14), polyamine (16), polythiol (17), etc.), and cured products of polyepoxide (18) with a dicarboxylic acid (β) or an acid anhydride of trivalent or higher polycarboxylic acid (14).

The polyepoxide (18) for use in the present invention is not particularly limited as long as it has two or more epoxy groups in its molecule. As the polyepoxide (18), a polyepoxide having 2 to 6 epoxy groups in its molecule is preferred from the viewpoint of mechanical strength of the resulting cured product. The epoxy equivalent amount (molecular weight of polyepoxide (18) per epoxy group) of the polyepoxide (18) is usually 65 g/equivalent amount to 1,000/equivalent amount, preferably 90 g/equivalent amount to 500 g/equivalent amount. When the epoxy equivalent amount is more than 1,000 g/equivalent amount, the crosslinked structure loosens, which leads to degradation of physical properties of the resulting cured product, such as water resistance, agent resistance, and mechanical strength. Whereas, it is difficult to synthesize a polyepoxide (18) having an epoxy equivalent amount of less than 65 g/equivalent amount.

Specific examples of the polyepoxide (18) include aromatic polyepoxy compounds, heterocyclic polyepoxy compounds, alicyclic polyepoxy compounds, and aliphatic polyepoxy compounds.

Examples of the aromatic polyepoxy compounds include glycidyl ethers of polyhydric phenols, and glycidyl esters of polyhydric phenols, glycidyl aromatic polyamines, glycidylated compounds of aminophenols.

Specific examples of the glycidyl ethers of polyhydric phenols include bisphenol F diglycidyl ether, bisphenol A diglycidyl ether, bisphenol B diglycidyl ether, bisphenol AD diglycidyl ether, bisphenol S diglycidyl ether, halogenated bisphenol A diglycidyl ether, resorcinol diglycidyl ether, hydroquinone diglycidyl ether, pyrogallol triglycidyl ether, dihydroxybiphenyl diglycidyl ether, tris(hydroxyphenypmethane triglycidyl ether, dinaphthyltriol triglycidyl ether, bis(dihydroxynaphthalene)tetraglycidyl ether, glycidyl ether of phenol or a cresol novolac resin, diglycidyl ether obtained by a reaction of bisphenol A (2 mol) with epichlorohydrin (3 mol), polyglycidyl ether of polyphenol obtained by a polycondensation reaction of phenol and glyoxal, glutaraldehyde or formaldehyde, and polyglycidyl ether of polyphenol obtained by a polycondensation reaction of resorcin with acetone.

Examples of the glycidyl esters of polyhydric phenols include diglycidyl phthalate, diglycidyl isophthalate, and glycidyl terephthalate.

Examples of the glycidyl aromatic polyamines include N,N-diglycidylaniline, N,N,N',N'-tetraglycidylxylylene amine, N,N,N',N'-tetraglycidyldiphenylmethane diamine.

Furthermore, in the present invention, the aromatic polyepoxy compounds encompass triglycidyl ether of p-aminophenol, a diglycidyl urethane compound obtained by an addition reaction of tolylene diisocyanate or diphenylmethane diisocyanate with glycidol, polyurethane (pre)polymer having a glycidyl group which is obtained by reacting polyol with one of the above-mentioned two reaction products, and diglycidyl ethers of AO (EO or PO) adducts of bisphenol A.

Examples of the heterocyclic polyepoxy compounds include tris(glycidyl) melamine.

Examples of the alicyclic polyepoxy compounds include vinyl cyclohexene dioxide, limonene dioxide, dicyclopentadiene dioxide, bis(2,3-epoxycyclopentyl)ether, ethylene glycol-bis-epoxy dicyclopentyl ether, bis(3,4-epoxy-6-methylcyclohexylmethyl)butyl amine, and dimer diglycidyl ester. In addition, the alicyclic polyepoxy compounds encompass nuclear hydrogenation products of aromatic polyepoxide compounds.

Examples of the aliphatic polyepoxy compounds include polyglycidyl ethers of polyhydric-aliphatic alcohols, polyglycidyl esters of polyhydric fatty acids, and glycidyl aliphatic amines.

Specific examples of the polyglycidyl ethers of polyhydric-aliphatic alcohols include ethylene glycol diglycidyl ether, propylene glycol diglycidyl ether, tetramethylene glycol diglycidyl ether, 1,6-hexanediol diglycidyl ether, polyethylene glycol diglycidyl ether, polypropylene glycol diglycidyl ether, polytetramethylene glycol diglycidyl ether, neopentyl glycol diglycidyl ether, trimethylolpropane polyglycidyl ether, glycerol polyglycidyl ether, pentaerythritol polyglycidyl ether, sorbitol polyglycidyl ether, and polyglycerol polyglycidyl ether.

Specific examples of the polyglycidyl esters of polyhydric fatty acids include diglycidyl oxalate, diglycidyl maleate, diglycidyl succinate, diglycidyl glutarate, diglycidyl adipate, and diglycidyl pimelate.

Specific examples of the glycidyl aliphatic amines include N,N,N',N'-tetraglycidyl hexamethylene diamine.

In the present invention, the aliphatic polyepoxy compound encompasses polymer and copolymers of diglycidyl ether, and glycidyl(meth)acrylate.

Among these, preferred are aliphatic polyepoxy compounds and aromatic polyepoxy compounds.

In the present invention, two or more different polyepoxides may be used in combination.

In the present invention, when the polyester-based resin or a solution thereof (the polyester-based resin precursor or a solution thereof) is dispersed in the aqueous solvent (and a reaction of the polyester-based resin precursor is performed) to form a toner, the resin particles are made to adsorb onto the surface of toner particles, thereby making it possible to prevent coalescence of the resin particles or the toner particles and to reduce the risk of splitting of the toner particles under application of high shearing force. With this, it is possible to maintain the particle diameter of the toner at a constant value and to improve the uniformity thereof. Therefore, the resin particles preferably have, for example, such properties that they have strength not to be damaged or split under shearing forth at a temperature employed in the dispersion process and they are hardly dissolved and swelling in water, as well as in the polyester-based resin or a solution thereof (and polyester-based resin precursor or a solution thereof).

The glass transition temperature (Tg) of the resin constituting the resin particles is usually 0° C. to 300° C., preferably 20° C. to 250° C., and more preferably 50° C. to 200° C. from the viewpoint of the uniformity and flowability of the resulting toner and the heat resistance and stress resistance during storage of the toner. When the glass transition temperature of the resin of constituting the resin particles is lower than the temperature in the preparation of the aqueous dispersion for toner, the effect of preventing coalescence of the resin particles or the toner particles and reducing the risk of splitting of the toner particles under application of high shearing force is reduced, the effect of improving the uniformity of particle diameter may be reduced. Note that the glass transition temperature can be measured by using DSC.

The harness of the resin particles as a Shore D hardness, which is a standard of hardness, is preferably 30 or higher, and particularly preferably from 45 to 100. In addition, the hardness of the resin particles when dipped in an organic solvent in water for a predetermined time length is also preferably within the above-mentioned range.

It is preferred to suitably control the crystallinity and average molecular weight between crosslinking points of the resin particles so that the resin particles have a molecular weight and an SP value of the resin constituting the resin particles from the viewpoint of preventing the resin particles being dissolved and/or swollen in water and the organic solvent used in the dispersion process. Note that the SP value can be determined by the calculation method described in Vol. 14, No. 2 pp. 147-154 of Polymer Engineering and Science, February, 1974.

The number average molecular weight (measured by GPC, hereinbelow, abbreviated as "Mn") of the resin constituting the resin particles is usually 200 to 5,000,000, and preferably 2,000 to 500,000. The SP value of the resin constituting the resin particles is preferably 7 to 18, and more preferably 8 to 14.

The melting point (measured by DSC) of the resin constituting the resin particles is preferably 50° C. or higher, and more preferably 80° C. or higher.

The heat resistance, water resistance, chemical resistance of the resulting toner and uniformity of particle diameter thereof are desired to be improved, a crosslinking structure may be introduced into the resin constituting the resin particles. The crosslinking structure referred here may be any of the crosslinking configurations of covalent bond, coordinate bond, ionic bond, hydrogen bond and the like. When a crosslinking structure is introduced into the resin constituting the resin particles, the molecular weight between crosslinking points of the resin is preferably 30 or more, and more preferably 50 or more.

Meanwhile, as described hereinbelow, when resin particles attached to surfaces of toner particles are desired to be dissolved to form an aqueous dispersion of toner, it is preferred not to introduce a crosslinking structured into the resin.

<Production Method of Aqueous Dispersion Liquid>

The method of producing an aqueous dispersion liquid of the resin particles is not particularly limited, but the following methods [1] to [8] are exemplified:

[1] A method when using a vinyl resin: a monomer is used as a starting material and subjected to a polymerization reaction process such as suspension polymerization, emulsion polymerization, seed polymerization, dispersion polymerization, and the like, so that an aqueous dispersion liquid is produced.

[2] A method when using a polyaddition or condensation type resin such as a polyester resin, polyurethane resin, epoxy resin, etc: a precursor (monomer, oligomer, etc.) or a solution thereof is dispersed in an aqueous medium in presence of a suitable dispersant, and then heated or a curing agent is added thereto, so as to be cured, so that an aqueous dispersion liquid is produced.

[3] A method when using a polyaddition or condensation type resin such as a polyester resin, polyurethane resin, epoxy resin, etc: an appropriate emulsifier is dissolved in a precursor (monomer, oligomer, etc.) or a solution (preferably a liquid, may be liquidized by heating) thereof, and then water is added thereto so as to effect phase inversion.

[4] A resin preliminarily synthesized by a polymerization reaction (which may be any of addition polymerization, ring opening polymerization, polyaddition, addition condensation, polycondensation, etc.) is pulverized using a jet-type fine powder pulverizer and then subjected to classification to obtain resin particles, and the resin particles are dispersed in water in the presence of a suitable dispersant.

[5] A solution of a resin preliminarily synthesized by a polymerization reaction (which may be any of addition polymerization, ring opening polymerization, polyaddition, addition condensation, polycondensation, etc.) is sprayed to obtain resin particles, and the resin particles are dispersed in water in the presence of a suitable dispersant.

[6] A poor solvent is added to a solution of a resin preliminarily synthesized by a polymerization reaction (which may be any of addition polymerization, ring opening polymerization, polyaddition, addition condensation, polycondensation, etc.) or a resin solution preliminarily prepared by heating or dissolving a resin, is cooled to precipitate resin particles, the solvent (poor solvent) is removed therefrom to obtain resin particles, and the resin particles are dispersed in water in the presence of a suitable dispersant.

[7] A solution of a resin preliminarily synthesized by a polymerization reaction (which may be any of addition polymerization, ring opening polymerization, polyaddition, addition condensation, polycondensation, etc.) is dispersed in an aqueous medium in the presence of a suitable dispersant, followed by removing the solvent through heating, depressurization or the like.

[8] An appropriate emulsifier is dispersed in a solution of a resin preliminarily synthesized by a polymerization reaction (which may be any of addition polymerization, ring opening polymerization, polyaddition, addition condensation, polycondensation, etc.), and then water is added thereto, so as to be phase inversion emulsified.

—Emulsifier, Dispersant or Emulsion Auxiliary, Dispersion Auxiliary—

In the above-mentioned methods [1] to [8], as the emulsifier or dispersant, a surfactant (S) and a water-soluble polymer (T), which are conventionally known in the art, can be used. In addition, an organic solvent (U) and a plasticizer (V) can be concurrently used as auxiliaries for emulsification or dispersion.

Examples of the surfactant (S) include an anionic surfactant (S-1), a cationic surfactant (S-2), an amphoteric surfactant (S-3), and a nonionic surfactant (S-4). Two or more different types of surfactants may be used for the surfactant (S).

Examples of the anionic surfactant (S-1) include carboxylic acids and salts thereof, sulfate salts, salts of carboxy methylated products, sulfonates, and phosphoric acid ester salts.

Examples of the carboxylic acids and salts thereof include saturated or unsaturated fatty acids having 8 to 22 carbon atoms and salts thereof. Specific examples the carboxylic acids are mixtures of higher fatty acids obtained by saponification of capric acid, lauric acid, myristic acid, palmitic acid, stearic acid, arachidic acid, behenic acid, oleic acid, linoleic acid, ricinoleic acid, palm oil, palm kernel oil, rice bran oil, beef tallow oil or the like. Specific examples of the salts of carboxylic acids are sodium salts, potassium salts, ammonium alts, and alkanol amine salts.

Specific examples of the sulfate salts include higher alcohol sulfate salts (sulfate salts of fatty alcohols having 8 to 18 carbon atoms), higher alkylether sulfate salts (sulfate salts of EO (1 to 10 mol) adduct of aliphatic alcohols having 8 to 18 carbon atoms), sulfated oils (those obtained by sulfating natural unsaturated fat and oil or natural unsaturated wax so as to be neutralized), sulfated fatty acid esters (those obtained by sulfating lower alcohol ester of unsaturated fatty acid so as to be neutralized), and sulfated olefins (those obtained by sulfating olefin having 12 to 18 carbon atoms so as to be neutralized). Specific examples of the salts thereof are sodium salts, potassium salts, ammonium alts, and alkanol amine salts.

Specific examples of the higher alcohol sulfate salts include octyl alcohol sulfate salts, decyl alcohol sulfate salts, lauryl alcohol sulfate salts, stearyl alcohol sulfate salts, sulfate salts of alcohols synthesized using a Ziegler catalyst (e.g. ALFOL 1214 (CONDEA Chemie GmbH)), sulfate ester salts of alcohols synthesized by an oxo method (e.g. DOVANOL 23, and 45 (produced by Mitsubishi Petrochemical Co., Ltd.), TRIDECANOL (produced by Kyowa Hakko Kogyo Co., Ltd.), OXOCOL 1213, 1215 and 1415 (produced by Nissan Chemical Industries Ltd.), and DIADOL 115-L, 115H and 135 (produced by Mitsubishi Kasei K.K.); specific examples of the higher alkyl ether sulfate salts include sulfate salts of EO (2 mol) adduct of lauryl alcohols; specific examples of the sulfate salts of EO (3 mol) adduct of octyl alcohols include, and sodium salts, potassium salts, ammonium salts and alkanol amine salts of sulfates of castor oil, olive oil, or canola oil; specific examples of the sulfated fatty acid esters include sodium salts, potassium salts, ammonium salts and alkanol amine salts of sulfates of butyl oleate, butyl ricinoleate or the like; and specific examples of the sulfated olefins include TEEPOL (produced by Shell).

Examples of the salts of carboxy methylated products include salts of carboxymethylated products of aliphatic alcohols having 8 to 16 carbon atoms, and salts of carboxymethylated products of EO (1 mol to 10 mol) adduct of aliphatic alcohols having 8 to 16 carbon atoms.

Specific examples of the salts of carboxymethylated products of aliphatic alcohols include carboxymethylated sodium salt of octyl alcohol, carboxymethylated sodium salt of lauryl alcohol, and carboxymethylated sodium salt of tridecanol; specific examples of the salt of carboxymethylated products of EO (1 to 10 mol) adduct of aliphatic alcohol include carboxymethylated sodium salt of EO (3 mol) adduct of octyl alcohols, carboxymethylated sodium salt of EO (4 mol) adduct of lauryl alcohol, and carboxymethylated sodium salt of EO (3 mol) adduct of DOVANOL 23.

Examples of the sulfonic acid salt include alkylbenzene sulfonic acid salt, alkyl naphthalene sulfonic acid salt, sulfosuccinic acid diester, α-olefin sulfonic acid salt, Igepon T sulfonic acid salt, and other sulfonic acid salts of a compound having an aromatic ring.

Specific examples of the alkylbenzene sulfonic acid salt include sodium dodecylbenzene sulfonate; and specific examples of the sodium salt of di(2-ethylhexyl)sulfosuccinate. Examples of the sulfonic acid salt of a compound having an aromatic ring include mono- or di-sulfonic acid salt of alkylated diphenyl ethers, and styrenated phenol sulfonic acid salts.

Examples of the phosphoric acid ester salts include higher alcohol phosphoric acid ester salt, and higher alcohol EO adduct phosphoric acid ester salt.

Specific examples of the higher alcohol phosphoric acid ester salt include lauryl alcohol phosphoric acid monoester disodium salt, lauryl alcohol phosphoric acid diester sodium salt; and specific examples of the higher alcohol EO adduct phosphoric acid ester salt include oleyl alcohol EO (5 mol) adduct phosphoric acid monoester disodium salt.

Examples of the cationic surfactant (S-2) include a quaternary ammonium salt surfactant, and an amine salt surfactant.

The quaternary ammonium salt surfactant can be obtained by a reaction of a tertiary amine with a quaternarizing agent (e.g. alkylating agent such as methyl chloride, methyl bromide, ethyl chloride, benzyl chloride, and dimethyl sulfate; EO, etc.), for example, lauryl trimethyl ammonium chloride, lauryl trimethyl ammonium chloride, didecyldimethyl ammonium chloride, dioctyldimethyl ammonium bromide, stearyl trimethyl ammonium bromide, lauryl dimethyl benzyl ammonium chloride (benzalkonium chloride), cetyl pyridinium chloride, polyoxyethylene trimethyl ammonium chloride, and stearamide ethyldiethylmethyl ammonium methosulfate.

The amine salt surfactant can be obtained by neutralizing primary to tertiary amines with an inorganic acid (e.g. hydrochloric acid, nitric acid, hydriodic acid, etc.) or an organic acid (e.g. acetic acid, formic acid, oxalic acid, lactic acid, gluconic acid, adipic acid, alkyl phosphoric acid, etc.).

Examples of the primary amine salt surfactant include inorganic acid salts or organic acid salts of higher aliphatic amines (e.g. higher amines such as lauryl amine, stearyl amine, cetyl amine, cured tallow amine, rosin amine, etc.); and higher fatty acid (stearic acid, oleic acid, etc.) salts of lower amines.

Examples of the secondary amine salt surfactant include inorganic acid salts or organic acid salts such as EO adduct of aliphatic amine.

Examples of the tertiary amine salt surfactant include aliphatic amines (e.g. triethyl amine, ethyldimethyl amine, N,N,N',N'-tetramethyl ethylene diamine, etc.), EO (2 mol or more) adduct of aliphatic amine, inorganic acid salts or organic acid salts of alicyclic amines (e.g. N-methylpyrrolidine, N-methylpiperidine, N-methylhexamethylene imine, N-methylmorpholine, 1,8-diazabicyclo(5,4,0)-7-undecene, etc.), nitrogen-containing heterocyclic aromatic amines (e.g. 4-dimethylaminopyridine, N-methyl imidazole, 4,4'-dipyridyl, etc.); and inorganic acid salts or organic acid salts of tertiary amines such as triethanol amine monostearate, and stearamide ethyldiethylmethyl ethanol amine.

As the amphoteric surfactant (S-3) for use in the present invention, it is possible to use a carboxylic acid salt type amphoteric surfactant, a sulfuric acid ester salt type amphoteric surfactant, a sulfonic acid salt type amphoteric surfactant, and a phosphoric acid ester salt type amphoteric surfactant.

Examples of the carboxylic acid salt type amphoteric surfactant include amino acid type amphoteric surfactant, betaine type amphoteric surfactant, and imidazoline type amphoteric surfactant. Among these, the amino acid type amphoteric surfactant is an amphoteric surfactant having an amino group and a carboxyl group in its molecule, and for example, a compound represented by the following general formula is exemplified.

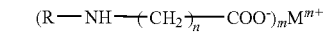

(In the above general formula, R represents a monovalent hydrocarbon group; n is generally an integer of 1 or 2; m is an integer of 1 or 2; and $M^{m+}$ represents a proton, alkali metal ion, alkali earth metal ion, ammonium ion, amine cation, alkanol amine cation, or the like.)

Specific examples of the compound include alkylamino propionate amphoteric surfactant (e.g. sodium stearyl amino propionate, sodium lauryl amino propionate, etc.); and alkyl amino acetate amphoteric surfactant (e.g. sodium lauryl amino acetate).

The betaine type amphoteric surfactant is an amphoteric surfactant having a quaternary ammonium salt type cationic group moiety and a carboxylic acid type anionic moiety, and examples thereof include alkyldimethyl betaine (e.g. betaine stearyldimethyl amino acetate, betaine lauryl dimethylamino acetate, etc.), amidobetaine (coco fatty acid amidopropyl betaine, etc.), alkyldihydroxyalkyl betaine (lauryldihydroxyethyl betaine, etc.).

Examples of the imidazoline type amphoteric surfactant include 2-undecyl-N-carboxymethyl-N-hydroxyethylimidazolinium betaine.

In addition, the following amphoteric surfactants are, for example, exemplified glycine type amphoteric surfactants such as sodium lauryl glycine, sodium lauryl diaminoethyl glycine, lauryldiaminoethylglycine hydrochloride, and dioctyldiaminoethylglycine hydrochloride; and sulfobetaine type amphoteric surfactants such as pentadecylsulfotaurine.

Examples of the nonionic surfactant (S-4) include an AO adduct-type nonionic surfactant, and a polyhydric alcohol type nonionic ion surfactant.

The AO adduct-type nonionic surfactant can be obtained by directly adding AO to a higher alcohol, a higher fatty acid, an alkylamine or the like, or by reacting polyalkylene glycols, which are obtained by adding AO to glycols, with a higher fatty acid or the like, or by adding AO to an ester obtained by reacting a higher fatty acid to a polyhydric alcohol, or by adding AO to a higher fatty acid amide.

Examples of the AO include EO, PO, and BO. An EO homopolymer, and a random or block copolymer of EO and PO are preferred.

The degree of polymerization of AO is preferably 10 to 50. The proportion of EO in the AO is preferably 50% to 100%.

Specific examples of the AO addition type nonionic surfactant include oxyalkylene alkyl ether (e.g. EO adduct of octyl alcohol, EO adduct of lauryl alcohol, EO adduct of stearyl alcohol, EO adduct of oleyl alcohol, EO/PO block adduct of lauryl alcohol, etc.); polyoxyalkylene higher fatty acid ester (e.g. EO adduct of stearic acid, EO adduct of lauric acid, etc.); polyoxyalkylene polyhydric alcohol higher fatty acid ester (e.g. lauric acid diester of polyethylene glycol, oleic acid diester of polyethylene glycol, stearic acid diester of polyethylene glycol, etc.); polyoxyalkylene alkylphenyl ether (e.g. EO adduct of nonyl phenol, EO/PO block adduct of nonyl phenol, EO adduct of octyl phenol, EO adduct of bisphenol A, EO adduct of dinonyl phenol, EO adduct of styrenated phenol, etc.); polyoxyalkylene alkylamino ether (e.g. EO adduct of lauryl amine, EU adduct of stearyl amine, etc.); polyoxyalkylene alkyl alkanol amide (e.g. EO adduct of hydroxyethyl lauric acid amide, EO adduct of hydroxypropyl oleic acid amide, EO adduct of dihydroxyethyl lauric acid amide, etc.).

Examples of the polyhydric alcohol type nonionic surfactant include fatty acid ester of polyhydric alcohol, AO adduct of polyhydric alcohol fatty acid ester, polyhydric alcohol alkyl ether, and AO adduct of polyhydric alcohol alkyl ether.

Specific examples of the polyhydric alcohol fatty acid ester include pentaerythritol monolaurate, pentaerythritol monooleate, sorbitan monolaurate, sorbitan monostearate, sorbitan monolaurate, sorbitan dilaurate, sorbitan oleate, and sucrose monostearate.

Specific examples of the AO adduct of polyhydric alcohol fatty acid ester include EO adduct of ethylene glycol monooleate, EO adduct of ethylene glycol monostearate, EO/PO random adduct of trimethylolpropane monostearate, EO adduct of sorbitan monolaurate, EO adduct of sorbitan monostearate, EO adduct of sorbitan distearate, and EO/PO random adduct of sorbitan dilaurate.

Specific examples of the polyhydric alcohol alkyl ether include pentaerythritol monobutyl ether, pentaerythritol monolauryl ether, sorbitan monomethyl ether, sorbitan monostearyl ether, methyl glycoside, and lauryl glycoside.

Specific examples of the AO adduct of polyhydric alcohol alkyl ether include EO adduct of sorbitan monostearyl ether, EO/PO random adduct of methyl glycoside, EO adduct of lauryl glycoside, and EO/PO random adduct of stearyl glycoside.

Examples of the water-soluble polymer (T) include a cellulose-based compound (e.g. methyl cellulose, ethyl cellulose, hydroxyethyl cellulose, ethyl hydroxyethyl cellulose, carboxymethyl cellulose, hydroxypropyl cellulose, saponification products thereof, etc.), gelatin, starch, dextrin, gum arabic, chitin, chitosan, polyvinyl alcohol, polyvinyl pyrrolidone, polyethylene glycol, polyethylene imine, polyacrylamide, an acrylic acid (acrylate)-containing polymer (sodium polyacrylate, potassium polyacrylic acid, ammonium polyacrylic acid, sodium hydroxide partially neutralized products of polyacrylic acid, and sodium acrylate-acrylic acid ester copolymer), a sodium hydroxide (partially) neutralized product of styrene-maleic anhydride copolymer, and water-soluble polyurethane (reaction products of polyisocyanate with polyethylene glycol, polycaprolactone diol, or the like).

The organic solvent (U) for use in the present invention may be added, if needed, in an aqueous medium for forming the aqueous dispersion liquid, or in a dispersion to be emulsified (an oil phase containing a polyester-based resin) in the emulsification dispersion process. When the organic solvent (U) is added in the aqueous medium, the addition amount of the organic solvent (U) is preferably 0% to 30%, more preferably 0% to 25%, and particularly preferably 1% to 20%. When it is added in the dispersion to be emulsified, the addition amount is preferably 0% to 80%, more preferably 0% to 70%, and particularly preferably 1% to 60%.

Specific examples of the organic solvent (U) include aromatic hydrocarbon-based solvents (e.g. toluene, xylene, ethyl benzene, tetralin, etc.); aliphatic or alicyclic hydrocarbon-based solvents (e.g. n-hexane, n-heptane, mineral spirit, cyclohexane, etc.); halogen-based solvents (e.g. methyl chloride, methyl bromide, methyl iodide, methylene chloride, carbon tetrachloride, trichloroethylene, perchloroethylene, etc.); ester-based or ester-ether-based solvents (e.g. ethyl acetate, butyl acetate, methoxy butyl acetate, methyl cellosolve acetate, ethyl cellosolve acetate, etc.); ether-based solvents (e.g. diethyl ether, tetrahydrofuran, dioxane, ethyl cellosolve, butyl cellosolve, propylene glycol monomethyl ether, etc.); ketone-based solvents (e.g. acetone, methylethylketone, methyl isobutyl ketone, di-n-butyl ketone, cyclohexanone, etc.); alcohol-based solvents (e.g. methanol, ethanol, n-propanol, isopropanol, n-butanol, iso-butanol, t-butanol, 2-ethylhexyl alcohol, benzyl alcohol, etc.); amide-based solvents (e.g. dimethylformamide, dimethylacetoamide, etc.); sulfoxide-based solvents (e.g. dimethyl sulfoxide, etc.), and heterocyclic compound-based solvents (e.g. N-methylpyrrolidone, etc.). Mixtures of two or more solvents selected from these solvents are also exemplified.

The organic solvent (U) to be added in the aqueous medium preferably has a solubility to water of 0% to 40%, more preferably 1% to 25%. Specific examples of the organic solvent having a solubility within the above range include ethyl acetate, butyl acetate, methyl ethyl ketone, and methyl isobutyl ketone.

The plasticizer (V) may be added, if desired, in the aqueous medium or dispersion to be emulsified (oil phase containing the polyester-based resin) during the emulsification dispersion process. The plasticizer (V) is not particularly limited, and examples thereof include phthalic acid esters (e.g. dibutyl phthalic acid, dioctyl phthalic acid, butylbenzyl phthalic acid, diisodecyl phthalic acid, etc.); aliphatic dibasic acid esters (e.g. di(2-ethylhexyl) adipate, 2-ethylhexyl sebacate, etc.); trimellitic acid esters (e.g. tri(2-ethylhexyl)trimellitate, trioctyl trimellitate, etc.); phosphoric acid esters (e.g. triethyl phosphate, tri(2-ethylhexyl)phosphate, tricresyl phosphate, etc.); fatty acid esters (e.g. butyl oleate, etc.); and mixtures thereof.

The particle diameter of the resin particles is usually smaller than that of the resulting toner. From the viewpoint of the uniformity of particle diameter, a particle diameter ratio (a volume average particle diameter of resin particle/a volume average particle diameter of toner) is preferably 0.001 to 0.3, and more preferably 0.003 to 0.25. When the particle diameter ratio is greater than 0.3, the resin particles do not efficiently adsorb onto the surface of the toner, and thus the particle size distribution of the toner tends to be wide.

The volume average particle diameter of the resin particles can be appropriately controlled within the above range of particle diameter ratio so as to be a particle diameter suitable for obtaining a toner having a desired particle diameter.

The volume average particle diameter of the resin particles is preferably 0.005 μm to 2 μm. The upper limit volume average particle diameter of the resin particles is more preferably 1 μm, particularly preferably 0.5 μm. The lower limit volume average particle diameter of the resin particles is more preferably 0.01 μm, particularly preferably 0.02 μm, most preferably 0.04 μm. However, for example, when it is desired to obtain a toner having a volume average particle diameter of 1 μm, the volume average particle diameter of the resin particles is preferably 0.005 μm to 0.3 μm, particularly preferably 0.001 μm to 0.2 μm.

When it is desired to obtain a toner having a volume average particle diameter of 10 μm, the volume average particle diameter of the resin particles is preferably 0.005 μm to 3 μm, particularly preferably 0.05 μm to 2 μm. Note that the volume average particle diameter can be measured by using a laser type particle size distribution analyzer A-920 (manufactured by Horiba Ltd.), a COULTER COUNTER (e.g. MULTISIZER III (manufactured by Beckman Coulter Co.)), as an optical system, ELS-800 using laser Doppler method (manufactured by Otsuka Electronics Co., Ltd.) or the like.

<Polyester-Based Resin>

The polyester-based resin can be obtained by polycondensation of an alcohol component with a carboxylic acid component, preferably, in the presence of an esterifying catalyst.

—Carboxylic Acid Component—

The major characteristic of a toner of the present invention is that the carboxylic acid component contains a modified purified rosin. With use of a modified purified rosin, the resulting toner can be fixed at an extremely low temperature, and storage stability can be improved. A purified rosin modified with an acrylic acid, fumaric acid or maleic acid is preferred.

Since an acrylic acid-modified rosin is a rosin having two functional groups, it can extend its molecular chain as part of the main chain of polyester to increase the molecular weight, and on the other hand, and thus the amount of low molecular weight components having a molecular weight of 500 or lower, i.e., the amount of a remaining monomer component and a remaining oligomer component is reduced, it is presumed that with use of an acrylic acid-modified rosin, such a remarkable effect that opposite physical properties of low-temperature fixability, offset resistance and storage stability can be concurrently improved can be exhibited.

Since a fumaric acid-modified rosin has an extremely high glass transition temperature (Tg) as compared with conventional rosins, the amount of the low molecular weight components is reduced, and it is presumed that with use of a fumaric acid-modified rosin, such an unpredictable remarkable effect that opposite physical properties of low-temperature fixability, offset resistance and storage stability can be concurrently improved can be exhibited.

Since a maleic acid-modified rosin has three functional groups and functions as a crosslinker, it is presumed that with use of a maleic acid-modified rosin, such a remarkable effect that opposite physical properties of low-temperature fixability, offset resistance and storage stability can be concurrently improved can be exhibited.

—Alcohol Component—

The alcohol component may contain aromatic alcohol such as an alkylene oxide adduct of bisphenol A, for example, polyoxypropylene (2,2)-2,2-bis(4-hydroxyphenyl)propane, and polyoxyethylene(2,2)-2,2-bis(4-hydroxyphenyl)propane, however, preferably, the alcohol component virtually contains only aliphatic alcohol. Note that the description "the alcohol component virtually contains only aliphatic alcohol" means that the aliphatic alcohol content is 90 mol % or more in the alcohol component.

Furthermore, a branched-chain alcohol having 3 carbon atoms is preferably used for the aliphatic alcohol component. Especially, 1,2-propanediol, which is a branched-chain alcohol having 3 carbon atoms, is effective to improve low-temperature fixability while maintaining offset resistance as compared to alcohol having 2 or less carbon atoms, and is effective to prevent degradation of storage stability associated with a decrease in glass transition temperature, as compared to branched alcohol having 4 or more carbon atoms. With use of 1,2-propanediol, the heat resistant storage stability and hot offset resistance can be concurrently improved. When the amount of 1,2-propanediol is 65 mol % or more in a dihydric alcohol component, excellent low-temperature fixability and excellent offset resistance can be exhibited.

The alcohol component may contain alcohols other than 1,2-propanediol within a range not impairing the object and interaction effects of the present invention. However, the amount of 1,2-propanediol is 65 mol % or more, preferably 70 mol % or more, more preferably 80 mol % or more, still more preferably 90 mol % or more in dihydric alcohol components.

As dihydric alcohol components other than 1,2-propanediol, 1,3-propanediol, ethylene glycol having a different number of carbon atoms, a hydrogenated bisphenol A, bisphenol F, or aliphatic dialcohol such as alkylene (C2 to C4) oxides (the average number of addition moles: 1 to 16) adduct thereof. The amount of the dihydric alcohols contained in the alcohol component is preferably 60 mol % to 95 mol %, more preferably 65 mol % to 90 mol %.

From the viewpoint of offset resistance, the alcohol component preferably contain 1,3-propanediol.

A molar ratio of 1,2-propanediol to 1,3-propanediol (1,2-propanediol/1,3-propanediol) in the alcohol component composed of a polyester-based resin (A) and a polyester resin (B) is preferably 99/1 to 65/35, more preferably 95/3 to 70/30, still more preferably 95/3 to 75/25.

When a trihydric or higher alcohol component is contained in the alcohol component, the hot offset resistance can be efficiently improved. The amount of the trihydric or higher alcohol component is preferably 20 mol % or less, more preferably 5 mol % to 30 mol % in the total amount of alcohol components. Examples of the trihydric or higher alcohol component include glycerin, pentaerythritol, trimethylolpropane, sorbitol, or alkylene (C2 to C4) oxide (the average number of addition moles: 1 to 16) adducts thereof. Especially, glycerin is preferred for not inhibiting the low-temperature fixability.

—Esterifying Catalyst—

It is preferable that the polycondensation of the alcohol components and the carboxylic acid component of the polyester resins be carried out in the presence of an esterifying catalyst.

Examples of the esterifying catalyst include Lewis acids such as p-toluene sulfonic acid; titanium compounds, and tin (II) compounds having no Sn—C bond. These esterifying catalysts may be used alone or in combination. In the present invention, a titanium compound and/or a tin (II) compound having no Sn—C bond are preferably used.

As the titanium compound, preferred is a titanium compound having a Ti—O bond, with an alkoxy group, an alkenyloxy group or acyloxy group each having carbon atoms of 1 to 28 in total being more preferred.

Examples of the titanium compound include titanium diisopropylate bis-triethanolaminate [$Ti(C_6H_{14}O_3N)_2(C_3H_7O)_2$], titanium diisopropylate bis-diethanolaminate [$Ti(C_4H_{10}O_2N)_2(C_3H_7O)_2$], titaniumdipentylate-bis ethanolaminate [$Ti(C_6H_{14}O_3N)_2(C_5H_{11}O)_2$], titaniumdiethylate bis triethanolaminate [$Ti(C_6H_{14}O_3N)_2(C_2H_5O)_2$], titaniumdihydroxy octylate-bis triethanolaminate [$Ti(C_6H_{14}O_3N)_2(OHC_8H_{16}O)_2$], titaniumdistearate-bis triethanolaminate [$Ti(C_6H_{14}O_3N)_2(C_{18}H_{37}O)_2$], titanium triisopropylate triethanolaminate [$Ti(C_6H_{14}O_3N)_1(C_3H_7O)_3$], and titanium monopropylate tris(triethanolaminate) [$Ti(C_6H_{14}O_3N)_3(C_3H_7O)_1$]. Among these, titanium diisopropylate bis-triethanolaminate, titanium diisopropylate bis-diethanolaminate and titanium dipentylate-bis triethanolaminate are preferable, and these compounds are available as commercial products from Matsumoto Trading Co., Ltd.

Specific examples of other preferred titanium compounds include, but not limited to, tetra-n-butyltitanate [$Ti(C_4H_9O)_4$], tetrapropyl titanate [$Ti(C_3H_7O)_4$], tetrastearyl titanate [$Ti(C_{18}H_{37}O)_4$], tetra tetramyristyl titanate [$Ti(C_{14}H_{29}O)_4$], tetraoctyl titanate [$Ti(C_8H_{17}O)_4$], dioctyl dihydroxy octyl titanate [$Ti(C_8H_{17}O)_2(OHC_8H_{16}O)_2$], and dimyristyl dioctyltitanate [$Ti(C_{14}H_{29}O)_2(C_8H_{17}O)_2$]. Among these, preferred are tetrastearyl titanate, tetramyristyl titanate, tetraoctyl titanate, and dioctyl dihydroxyoctyl titanate. These can be obtained by reacting a hydrogenated titanium with the corresponding alcohol or are available from Nisso Co. Ltd. as commercial products.

The amount of the titanium compound present is preferably 0.01 parts by mass to 1.0 part by mass, more preferably 0.1 parts by mass to 0.7 parts by mass per 100 parts by mass of the total amount of the alcohol components and the carboxylic acid component.

As the tin (II) compound having no Sn—C bond, preferred are a tin (II) compound having an Sn—O bond, a tin (II) compound having an Sn—X (where X represents a halogen atom) bond, and the like; with a tin (II) compound having an Sn—O bond being more preferred.

Examples of the tin (II) compound having an Sn—O bond include, for example, tin (II) carboxylates having carboxylic acid groups with 2 to 28 carbon atoms, such as tin (II) oxalate, tin (II) diacetate, tin (II) dioctanoate, tin (II) dilaurate, tin (II) distearate, and tin (II) dioleate; dialkoxy tin (II) having alkoxy groups with 2 to 28 carbon atoms, such as dioctyloxy tin (II), dilauryoxy tin (II), distearoxy tin (II), and dioleyloxy tin (II); tin (II) oxides; and tin (II) sulfates. Examples of the tin (II) compound having an Sn—X (where X represents a halogen atom) bond include halogenated tin (II) such as tin (II) chlorides, tin (II) bromides. Among these, in terms of charge start-up characteristics and catalytic capacity, fatty acid tin (II) represented by $(R_1COO)_2Sn$ (where $R_1$ represents an alkyl group or alkenyl group having 5 to 19 carbon atoms), dialkoxy tin (II) represented by $(R_2O)_2Sn$ (where $R_2$ represents an alkyl group or alkenyl group having 6 to 20 carbon atoms), and tin (II) oxides represented by SnO are preferred; fatty acid tin (II) represented by $(R_1COO)_2Sn$ and tin (II) oxides are more preferred; with tin (II) dioctanoate, tin (II) distearate and tin (II) oxides being still more preferred.

The amount of the tin (II) compound present is preferably 0.01 parts by mass to 1.0 part by mass, and more preferably 0.1 parts by mass to 0.7 parts by mass per 100 parts by mass of the total amount of the alcohol components and the carboxylic acid component.

When the titanium compound is used in combination with the tin (II) compound, the total amount of the titanium compound and the tin (II) compound present is preferably 0.01 parts by mass to 1.0 part by mass, more preferably 0.1 parts by mass to 0.7 parts by mass per 100 parts by mass of the total amount of the alcohol components and the carboxylic acid component.

The polycondensation of the alcohol components and the carboxylic acid component can be carried out, for example, in the presence of the esterifying catalyst, in an inactive gas atmosphere at a temperature of 180° C. to 250° C.

<Releasing Agent>

In the present invention, for the purpose of preventing the occurrence of offset during fixation, waxes may be incorporated, as a releasing agent, into the toner.

The waxes are not particularly limited and may be suitably selected from those generally used as releasing agents for toner. Examples of the waxes include aliphatic hydrocarbon waxes (e.g. low-molecular-weight polyethylene, low-molecular-weight polypropylene, polyolefin wax, microcrystalline wax, paraffin wax, SASOL wax), oxides of aliphatic hydrocarbon waxes (e.g. polyethylene oxide wax) and block copolymers thereof, plant waxes (e.g. candelilla wax, carnauba wax, haze wax, jojoba wax), animal waxes (e.g. bees wax, lanoline, spermaceti wax), mineral waxes (e.g. ozokerite, ceresin, petrolatum), waxes including fatty acid esters (e.g. montanic acid ester wax, castor wax) as a main component, and partially or completely deacidified fatty acid esters (e.g. deacidified carnauba wax).

In addition, the following compounds can also be used: saturated straight-chain fatty acids (e.g. palmitic acid, stearic acid, montanic acid, and other straight-chain alkyl carboxylic acid), unsaturated fatty acids (e.g. brassidic acid, eleostearic acid, parinaric acid), saturated alcohols (e.g. stearyl alcohol, eicosyl alcohol, behenyl alcohol, carnaubyl alcohol, ceryl alcohol, melissyl alcohol, and other long-chain alkyl alcohol), polyols (e.g. sorbitol), fatty acid amides (e.g. linoleic acid amide, olefin acid amide, lauric acid amide), saturated fatty acid bisamides (e.g. methylenebis capric acid amide, ethylenebis lauric acid amide, hexamethylenebis capric acid amide), unsaturated fatty acid amides (e.g. ethylenebis oleic acid amide, hexamethylenebis oleic acid amide, N,N'-dioleyl adipic acid amide, N,N'-dioleyl sebacic acid amide), aromatic biamides (e.g. m-xylenebis stearic acid amide, N,N-distearyl isophthalic acid amide), metal salts of fatty acids (e.g. calcium stearate, calcium laurate, zinc stearate, magnesium stearate), aliphatic hydrocarbon waxes to which a vinyl monomer such as styrene and an acrylic acid is grafted, partial ester compounds between a fatty acid such as behenic acid monoglyceride and a polyol, and methyl ester compounds having a hydroxyl group obtained by hydrogenating plant fats.

In particular, the following compounds are preferably used: a polyolefin obtained by radical polymerizing an olefin under high pressure; a polyolefin obtained by purifying low-molecular-weight by-products of a polymerization reaction of a high-molecular-weight polyolefin; a polyolefin polymerized under low pressure in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthesized hydrocarbon waxes obtained by synthol method, hydrocoal method, or Arge method; synthesized waxes containing a compound having one carbon atom as a monomer unit; hydrocarbon waxes having a functional group such as hydroxyl group and carboxyl group; mixtures of a hydrocarbon wax and that having a functional group; and these waxes to which a vinyl monomer such as styrene, a maleate, an acrylate, a methacrylate, and a maleic anhydride is grafted.

In addition, these waxes subjected to a press sweating method, a solvent method, a recrystallization method, a vacuum distillation method, a supercritical gas extraction method, or a solution crystallization method, so as to much more narrow the molecular weight distribution thereof are preferably used. Further, low-molecular-weight solid fatty acids, low-molecular-weight solid alcohols, low-molecular-weight solid compounds, and other compounds from which impurities are removed are preferably used.

The wax preferably has a melting point of from 60° C. to 140° C., more preferably from 70° C. to 120° C., so that the resultant toner has a good balance of toner blocking resistance and offset resistance. When the melting point is lower than 60° C., the blocking resistance of toner may degrade. When the melting point is higher than 140° C., the offset resistance may be hardly exhibited.

In the present invention, an endothermic maximum peak temperature of a wax measured by DSC (differential scanning calorimetry) is a melting point of the wax.

As a DSC measurement instrument for use to measure the endothermic maximum peak temperature of the wax or toner, a high-precision inner-heat power-compensation differential scanning calorimeter is preferably used. The measurement is performed according to a method based on ASTM D3418-82. The endothermic curve is obtained by heating a sample at a temperature increasing rate of 10° C./min, after once heating and cooling the sample.

In the present invention, the toner preferably contains the releasing agent in an amount of 1% by mass to 30% by mass, more preferably 2% by mass to 20% by mass.

<Colorant>

The colorant is not particularly limited and may be suitably selected from among those generally used in toner. Specific examples of colorants include carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, parachloro-ortho-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc.

The toner preferably contains the colorant in an amount of 1% by mass to 15% by mass, more preferably 3% by mass to 10% by mass.

The colorant can be combined with a resin to be used as a master batch. Specific examples of the resin to be kneaded with the master batch include, but are not limited to, polyester resins, polymers of styrenes and substituted styrenes (e.g. polystyrene, poly-p-chlorostyrene, polyvinyl toluene), styrene copolymers (e.g. styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), acrylic resins (e.g. polymethyl methacrylate, polybutyl methacrylate), polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin, and paraffin waxes. These resins may be used alone or in combination.

The master batches as mentioned above can be prepared by mixing resins (resins for use in masterbatches) and the colorant and kneading the mixture while applying a high shearing force thereto. In this case, an organic solvent can be added to increase the interaction between the colorant and the resin. In addition, a flushing method (in which an aqueous paste including a colorant and water is mixed with a resin dissolved in an organic solvent and kneaded so that the colorant is transferred to the resin side, and then the organic solvent and water are removed) can be preferably used because the resultant wet cake can be used as is without being dried. When performing the mixing and kneading process, dispersing devices capable of applying a high shearing force such as three roll mills can be preferably used.

The toner preferably contains the master batch in an amount of from 2 parts by mass to 30 parts by mass per 100 parts by mass of the binder resin.

Further, it is preferred that the resin for use in the masterbatch preferably have an acid value of 30 mgKOH/g or less and an amine value of 1 mgKOH/g to 100 mgKOH/g and a colorant be dispersed in the resin before use. It is more preferred that the resin preferably have an acid value of 20 mgKOH/g or less and an amine value of 10 mgKOH/g to 50 mgKOH/g and a colorant be dispersed therein before use. When the acid value of the resin is more than 30 mgKOH/g, the chargeability of the resulting toner may degrade under high humidity conditions, and the pigment dispersibility may be insufficient. When a resin having an amine value less than 1 mgKOH/g or more than 100 mgKOH/g is used, the pigment dispersibility may be insufficient. The acid value can be measured by a method described in JIS K0070, and the amine value can be measured by a method described in JIS K7237.

The colorant dispersing agent preferably has high compatibility with the binder resin in terms of pigment dispersibility. Specific examples of useable commercially available colorant dispersing agents include, but are not limited to, AJISPER PB-821 and PB-822 (produced by Ajinomoto-Fine-Techno Co., Inc.), DISPERBYK-2001 (produced by BYK-Chemie Gmbh), and EFKA 4010 (produced by EFKA Additives By).

The colorant dispersing agent preferably has a mass average molecular weight, which is a local maximum value of the main peak observed in the molecular weight distribution measured by GPC (gel permeation chromatography) and converted from the molecular weight (mass) of styrene, of from 500 to 100,000, more preferably from 3,000 to 100,000, from the viewpoint of enhancing dispersibility of the colorant. In particular, the mass average molecular weight is preferably from 5,000 to 50,000, and most preferably from 5,000 to 30,000. When the mass average molecular weight is less than 500, the dispersing agent has too high a polarity, and therefore dispersibility of the colorant sometimes degrades. When the mass average molecular weight is more than 100,000, the dispersing agent has too high an affinity for the solvent, and therefore dispersibility of the colorant sometimes degrades.

The toner preferably includes the colorant dispersing agent in an amount of from 1 part by mass to 50 parts by mass, and more preferably from 5 parts by mass to 30 parts by mass per 100 parts by mass of the colorant. When the amount is less than 1 part by mass, the colorant cannot be sufficiently dispersed. When the amount is more than 50 parts by mass, chargeability of the resultant toner may degrade.

<Preparation of Aqueous Dispersion of Toner>

In the present invention, a polyester-based resin or a solution thereof is dispersed in an aqueous dispersion liquid containing a resin particle to form a toner composed of a colorant, the polyester-based resin, and a releasing agent, which is added if necessary, and thus an aqueous dispersion of toner having a structure where the resin particle adheres on the surface of toner can be obtained. Alternatively, a polyester-based resin precursor, which is described below, or a solution thereof is dispersed in an aqueous dispersion liquid containing a resin particle. The polyester-based resin precursor is subjected to a polyaddition reaction to form a toner, and thus an aqueous dispersion of toner, having a structure where the resin particle adheres on the surface of toner, can be obtained.

When the polyester-based resin or solution thereof (polyester-based resin precursor or solution thereof) is dispersed in the aqueous dispersion liquid, a dispersing device can be used. The dispersing machine is not particularly limited as long as it is commercially available as an emulsifier or a disperser. Specific examples of the dispersing machine include batch-type emulsifiers such as HOMOGENIZER (manufactured by IKA Labortechnik), POLYTRON (manufactured by KINEMATICA), and TK AUTO HOMOMIXER (manufactured by Tokushu Kika Kogyo Co., Ltd.), continuous-type emulsifiers such as EBARA MILDER (manufactured by Ebara Corporation), TK FILMICS and TK PIPELINE HOMOMIXER (which are manufactured by Tokushu Kika Kogyo Co., Ltd.), COLLOID MILL (manufactured by Shinko Pantec Co., Ltd.), SLUSHER and TRIGONAL WET MILL (which are manufactured by Mitsui Miike Kakoki K.K.), CAVITRON (manufactured by EUROTEC Ltd.), and FINE FLOW MILL (manufactured by Pacific Machinery & Engineering Co., Ltd.), high-pressure emulsifiers such as MICROFLUIDIZER (manufactured by Mizuho Industrial Co., Ltd.), NANOMIZER (manufactured by Nanomizer Inc.), and APV GAULIN (manufactured by Gaulin Inc.), membrane emulsifiers such as membrane emulsifier (manufactured by REIKA Kogyo Co., Ltd.), vibration-type dispersing machines such as VIBROMIXER (manufactured by REIKA Kogyo CO., Ltd.), and ultrasonic emulsifiers such as ULTRASONIC HOMOGENIZER (manufactured by BRANSON). Among these dispersing machines, in terms of the uniformity of particle size, APV GAULIN, HOMOGENIZER, TK AUTO HOMOMIXER, EBARA MILDER, TK FILMICS, or TK PIPELINE HOMOMIXER is preferably used.

When a colorant and the polyester-based resin (or polyester-based resin precursor) is dispersed in an aqueous dispersion liquid containing a resin particle, the polyester-based resin (or polyester-based resin precursor) is preferably liquid. When the polyester-based resin (or polyester-based resin precursor) is solid at room temperature, it is possible to disperse it in a liquid state at a temperature higher than the melting point thereof, or to use a solution of the polyester-based resin (or polyester-based resin precursor). For improvement in uniformity of particle size, the viscosity of the polyester-based resin (or polyester-based resin precursor) is generally 10 cP to 50,000 cP (measured with a B-type viscometer), more preferably 100 cP to 10,000 cP. The temperature of the dispersion liquid is generally 0° C. to 150° C. (under application of pressure), and preferably 5° C. to 98° C. When the dispersion has a high viscosity, it is preferable to perform emulsification-dispersion after heating a solution of the polyester-based resin (or polyester-based resin precursor) so as to lower the viscosity to the above-mentioned preferred viscosity range.

The organic solvent for use in the solution of the polyester-based resin (or polyester-based resin precursor) is not particularly limited as long as it can dissolve the polyester-based resin (polyester-based resin precursor) at room temperature or under application of heat. Specifically, the same ones as the above-mentioned organic solvent (U) are exemplified. Preferred organic solvents differ depending on the type of the polyester-based resin (or polyester-based resin precursor) used. However, the difference in SP value between the organic solvent and the polyester-based resin (or polyester-based resin precursor) is preferably 3 or less. From the viewpoint of the uniformity of particle size of the resulting toner, an organic solvent which dissolves the polyester-based resin (polyester-based resin precursor), but which hardly dissolves and hardly swells resin particles is preferred.

The polyester-based resin precursor is not particularly limited as long as it can be transformed into a polyester-based resin through a chemical reaction. For example, a prepolymer (α) having a reactive group is exemplified, and a polyester-based resin can be obtained by reacting it with a curing agent (β). Note that the "reactive group" is a functional group having reactivity with the curing agent. In this case, as a method of reacting the polyester-based resin precursor to form a polyester-based resin, there may be exemplified a method in which an oil phase containing a prepolymer (α) having a reactive group, a curing agent (β) and an organic solvent (U) if necessary is dispersed in an aqueous dispersion liquid containing a resin particle and heated to effect a reaction of the prepolymer (α) with the curing agent (β); a method in which a prepolymer (α) having a reactive group or a solution thereof is dispersed in an aqueous dispersion liquid containing a resin particle, and a water-soluble curing agent (β) is added thereto to effect a reaction of the prepolymer (α) with the curing agent (β); and when the prepolymer (α) having a reactive group reacts with water to be cured, a method in which the prepolymer (α) having a reactive group or a solution thereof is dispersed in an aqueous dispersion liquid containing a resin particle to effect a reaction with water.

As a combination of the reactive group possessed by the prepolymer (α) with the curing agent (β), the following combinations are exemplified:

1] A combination of a prepolymer (α) having a reactive group, with a curing agent (β), in which a reactive group possessed by the prepolymer (α) is a functional group (α1) having reactivity with an active hydrogen group, and the curing agent (β) is a compound (β1) having an active hydrogen group.

2] A combination of a prepolymer (α) having a reactive group, with a curing agent (β), in which a reactive group possessed by the prepolymer (α) is an active hydrogen group (α2), and the curing agent (β) is a compound (β2) which has reactivity with an active hydrogen group.

Among these, for improvement of the rate of reaction in water, the combination of 1] is more preferred. In the combination of 1], as the functional group (α1) having reactivity with an active hydrogen group, preferred are isocyanate group (α1a), blocked isocyanate group (α1b), epoxy group (α1c), acid anhydride group (α1d), and acid halide group (α1e). Among these, isocyanate group (α1a), blocked isocyanate group (α1b), and epoxy group (α1c) are preferred, and isocyanate group (α1a), and blocked isocyanate group (α1b) are particularly preferred. In the present invention, the blocked isocyanate group (α1b) is an isocyanate group blocked with a blocking agent.

Examples of the blocking agent for use in the blocked isocyanate group include oximes (e.g. acetoxime, methylisobutyl ketoxime, diethyl ketoxime, cyclopentanone oxime, cyclohexanone oxime, methyl ethyl ketoxime, etc.); lactams (γ-butylolactam, ε-caprolactam, γ-valerolactam, etc.); aliphatic alcohols having 1 to 20 carbon atoms (ethanol, methanol, octanol, etc.); phenols (phenol, m-cresol, xylenol, nonylphenol, etc.); active methylene compounds (acetylacetone, ethyl malonate, ethyl acetoacetate, etc.); basic nitrogen-containing compounds (N,N-diethylhydroxylamine, 2-hydroxypyridine, pyridine-N-oxide, 2-mercaptopyridine, etc.); and mixtures thereof. Among these, oximes are preferred, and methyl ethyl ketoxime is particularly preferred.

As a skeleton of the prepolymer (α) having a reactive group, there may be exemplified a polyester resin obtained by polycondensation of an alcohol component with a carboxylic acid component containing a modified purified rosin. As a method of modifying a polyester resin with a reactive group, the following methods are exemplified.

[1] A method in which one of two or more components is used in excessive amount to make functional groups of the components remain at ends of the molecule.

[2] A method in which one of two or more components is used in excessive amount to make functional groups of the components remain at ends of the molecule and to react with a compound having functional groups which have reactivity with the remaining functional groups made to remain at the ends of the molecule.

In specific examples of the method [2], polyisocyanate is reacted with a prepolymer obtained in the method [1] to thereby yield a prepolymer having an isocyanate group; a blocked polyisocyanate is reacted with a prepolymer obtained in the method [1] to thereby yield a prepolymer having a blocked isocyanate group; a polyepoxide is reacted with a prepolymer obtained in the method [1] to thereby yield a prepolymer having an epoxy group; and acid polyanhydride is reacted with a prepolymer obtained in the method [1] to thereby yield a prepolymer having an acid anhydride group.

As for the amount of the compound having a functional group which has reactivity with the remaining functional group, for example, when polyisocyanate is reacted with polyester having a hydroxyl group to yield a polyester prepolymer having an isocyanate group, a ratio of the polyisocyanate is, in terms of an equivalent ratio [NCO]/[OH] of the amount of the isocyanate group [NCO] to the amount of the hydroxyl group [OH] in the polyester having a hydroxyl group, usually 1/1 to 5/1, preferably 1.2/1 to 4/1, more preferably 1.5/1 to 2.5/1. As for the other skeletons and the prepolymer having end groups, the same ratio is applied thereto, with only changing the components.

The number of reactive groups contained per molecule of the prepolymer (α) having a reactive group is usually one or more, preferably 1.5 to 3 on the average, more preferably 1.8 to 2.5 on the average. With this, the molecular weight of the polyester-based resin obtained by reaction with the curing agent (β) can be increased.

The number average molecular weight (Mn) of the prepolymer (α) having a reactive group is usually 500 to 30,000, preferably 1,000 to 20,000, still more preferably 2,000 to 10,000.

The mass average molecular weight (Mw) of the prepolymer (α) having a reactive group is usually 1,000 to 50,000, preferably 2,000 to 40,000, more preferably 4,000 to 20,000.

The viscosity of the prepolymer (α) having a reactive group at a temperature of 100° C. is usually, 2,000 poises or less, preferably 1,000 poises or less. By adjusting the viscosity of the prepolymer (α) to 2,000 poises or less, a toner having a sharp particle size distribution can be obtained with a small amount of organic solvent.

Examples of the compound (β1) having an active hydrogen group includes polyamine (β1a) that may be blocked with a removable compound; polyol (β1b), polymercaptan (β1c), and water (β1d). Among these, preferred are polyamine (β1a), polyol (β1b) and water (β1d), and more preferred are polyamine (β1a) and water (β1d), with blocked polyamine and water (β1d).

As the polyamine (β1a), the same ones as those described in the polyamine (16) can be used. Preferred examples of the polyamine (β1a) include 4,4'-diaminodiphenylmethane, xylylene diamine, isophorone diamine, ethylene diamine, diethylene triamine, triethylene tetramine, and mixtures thereof.

When the polyamine (β1a) is a polyamine that may be blocked with a desorbable compound, specific examples of the polyamine (β1a) include, but are not limited to, ketimine compounds obtained from polyamine and ketones having 3 to 8 carbon atoms (acetone, methyl ethyl ketone, methyl isobutyl ketone, etc.); and aldimine compounds, enamine compounds and oxazolidine compounds obtained from polyamine and aldehyde compounds having 2 to 8 carbon atoms (formaldehyde, acetaldehyde).

As the polyol (β1b), the same ones as those described in the diol (11) and polyol (12) can be used. Among these compounds, a diol (11) or a mixture of diol (11) with a small amount of polyol (12) is preferred.

Examples of the polymercaptan (β1c) include ethylene dithiol, 1,4-butanedithiol, and 1,6-hexanedithiol In addition, if necessary, a reaction stopper (βs) can be used together with the compound (β1) having an active hydrogen group. By using a reaction stopper together with the compound (β1) having an active hydrogen group at a certain mixture ratio, the molecular weight of the resulting polyester-based resin can be adjusted to a predetermined value.

Examples of the reaction stopper (βs) include monoamines (diethylamine, dibutylamine, butylamine, laurylamine, monoethanolamine, diethanoamine, etc.); reaction stoppers blocked with monoamine (ketimine compounds, etc.); alcohols (methanol, ethanol, isopropanol, butanol, phenol, etc.); monomercaptans (butyl mercaptan, lauryl mercaptan, etc.); monoisocyanates (lauryl isocyanate, phenyl isocyanate, etc.); and monoepoxides (butyl glycidyl ether, etc.).

Examples of the active hydrogen group (α2) possessed by the prepolymer having a reactive group in [2] described above include amino group (α2a), hydroxyl group (alcoholic hydroxyl group and phenoric hydroxyl group) (α2b), mercapto group (α2c), carboxyl group (α2d), and a functional group blocked with a compound capable of desorbing these groups (α2e). Among these, preferred are amino group (α2a), hydroxyl group (α2b) and a functional group blocked with a compound capable of desorbing amino groups, with hydroxyl group (α2b) being more preferred.

As the functional group blocked with a compound capable of desorbing amino groups, the same ones as those described in polyamine (β1a) may be exemplified.

Examples of the compound β2) having reactivity with active hydrogen groups include polyisocyanate (β2a), polyepoxide (β2b), polycarboxylic acid (β2c), acid polyanhydride (β2d), and polycarboxylic acid halide (β2e). Among these, preferred are polyisocyanate (β2a) and polyepoxide (β2b), and polyisocyanate (β2a) is more preferred.

As the polyisocyanate (β2a), the same ones as those described in polyisocyanate (15) can be used. Preferred ones are also the same as those described therein.

As the polyepoxide (β2b), the same ones as those described in polyepoxide (18) can be used. Preferred ones are also the same as those described therein.

As the polycarboxylic acid (β2c), dicarboxylic acid (β2c-1) and trivalent or higher polycarboxylic acid (β2c-2) are exemplified. Preferred are dicarboxylic acid (β2c-1) and a mixture of dicarboxylic acid (β2c-1) and a small amount of polycarboxylic acid (β2c-2).

As the dicarboxylic acid (β2c-1) and trivalent or higher polycarboxylic acid (β2c-2), the same ones as those described in each of the dicarboxylic acid (13) and the polycarboxylic acid (5) are exemplified. Preferred ones are also the same as those described therein.

As the acid polyanhydride (β2d), pyromellitic acid anhydrides are exemplified.

As the polycarboxylic acid halide (β2e), halides (acid chloride, acid bromide, and acid iodide) of the polycarboxylic acid (β2c) are exemplified.

Further, if desired, a reaction stopper (βs) can be used together with the polycarboxylic acid (β2).

A ratio of the curing agent (β) to the prepolymer (α) having a reactive group is, in terms of an equivalent ratio [α]/[β] of an equivalent amount [α] of the reactive group of the prepolymer (α) having a reactive group to an equivalent amount [β] of the active hydrogen group in the curing agent (β), usually from 1/2 to 2/1, preferably from 1.5/1 to 1/1.5, and more preferably from 1.2/1 to 1/1.2. Note that when the curing agent (β) is water (β1d), water is treated as a compound having a divalent active hydrogen.

A polyester-based resin (A) which can be obtained by reacting the prepolymer (α) having a reactive group with the curing agent (β) in an aqueous dispersion liquid will be a component of the toner according to a second embodiment of the present invention. The mass average molecular weight (Mw) of the polyester-based resin (A) obtained by reacting the prepolymer (α) having a reactive group with the curing agent (β) is usually 3,000 or more, preferably 3,000 to 10,000,000, and more preferably 5,000 to 1,000,000.

In addition, in the toner according to the second embodiment of the present invention, when reacting the prepolymer (α) having a reactive group with the curing agent (β) in an aqueous dispersion liquid, a polyester-based resin (B) which is unreactive with the prepolymer (α) having a reactive group and the curing agent (β) is further contained in the aqueous dispersion liquid. In this case, a weight ratio of the polyester-based resin (B) to the prepolymer (α) is preferably from 5/95 to 80/20.

A resin composed of the prepolymer (α) and the polyester-based resin (B) preferably has an oxidation degree of 1 mgKOH/g to 30 mgKOH/g and a glass transition degree (Tg) of 40° C. to 70° C.

The reaction time required for reacting the prepolymer (α) having a reactive group with the curing agent (β) is suitably selected depending on a combination of the prepolymer (α) having a reactive group and the curing agent (β) The reaction time, however, preferably 10 minutes to 40 hours, and more preferably 30 minutes to 24 hours. The reaction temperature is usually 0° C. to 150° C., and preferably 50° C. to 120° C.

In addition, if desired, a known catalyst can be used. Specifically, for example, in the case of a reaction of isocyanate with a compound having an active hydrogen group, dibutyl tin laurate and dioctyl tin laurate are exemplified as the catalyst.

<Drying>

In the present invention, in order to remove the solvent from the resulting emulsified dispersion liquid, a method of gradually reducing and/or gradually heating the entire system can be used.

Besides the above-mentioned method, the emulsified dispersion liquid is sprayed in a dry atmosphere and the organic solvent in liquid droplets thus formed is completely removed to thereby form a toner and remove the dispersant therein through evaporation. As the dry atmosphere into which the emulsified dispersion liquid is sprayed, a heated gas (heated air, heated nitrogen gas, heated carbon dioxide, combustion gas, etc.) can be used. In particular, various air streams heated at a temperature higher than the highest boiling point of the solvent used are generally employed. The solvent can be removed in a small amount of time through use of a spray drier, a belt drier, a rotary kiln or the like.

To remove an aqueous solvent from the emulsified dispersion liquid, the emulsified dispersion liquid is preferably filtered.

In the present invention, when particles in the emulsified dispersion liquid have a broad particle diameter distribution, and the particle diameter distribution is not changed even after the particles are subjected to washing and drying treatment, particles can be classified to have a desired particle diameter distribution.

The particles can be classified by removing fine particles by methods such as cyclone, decantation, centrifugal separation, etc. in a liquid. Of course, the dried particles can be classified by the above methods. However, the classification is preferably preformed in a liquid from the viewpoint of efficiency. Removed fine particles and coarse particles can be recycled to the kneading process to be used in toner particle formation process. The removed fine particles and coarse particles may be wet.

The dispersant in the emulsified dispersion liquid is preferably removed therefrom in the classification process The dried toner particles can be mixed with other particulate materials such as releasing agent, charge controlling agent, fluidizer, colorant, etc., optionally upon application of a mechanical impact thereto to fix and fuse the particulate materials on the surface of the toner particles, whereby it is possible to prevent heterogeneous particulate materials from desorbing from the surface of the resulting composite particles.

Specific examples of such mechanical impact application methods include, but are not limited to, methods in which a mixture is mixed with a highly rotated blade and methods in which a mixture is put into an air jet to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

<Amount of Remaining Resin Particle>

In the present invention, the resin particle is added in the toner particle formation process in order to control the aftermentioned toner shape (Here, shape refers to traits such as circularity and shape factor). It is important that the resultant toner includes the resin particles remaining on the surface thereof in an amount of 2.5% or less. For this reason, excess resin particles remaining on the surface of the toner are preferably washed and removed to some extent. When the remaining rate of the resin particles is more than 2.5%, the resin particles tend to inhibit toner fixation to paper, resulting in an increase of lower limit fixing temperature. As a result, the resultant toner has a narrow fixable temperature range. Such a toner cannot be well fixed in a low-temperature fixing system, and therefore the fixed image is easily peeled off by being scratched. In addition, resin particles remaining on the surface of the toner tend to degrade chargeability of the toner. As a result, problems such as background fouling of the produced image, toner scattering in developing regions, and toner contamination of various image forming members, are caused.

The amount of the remaining resin particle can be measured by pyrolysis gas chromatography (mass spectrometry) and calculated from the peak area obtained in the chromatograph.

<Volume Average Particle Diameter and Number Average Particle Diameter>

The toner of the present invention preferably has a volume average particle diameter (Dv) of from 4 μm to 8 μm and preferably has a ratio (Dv/Dn) of the volume average particle diameter (Dv) to a number average particle diameter (Dn) of 1.25 or less, more preferably from 1.00 to 1.25, still more preferably 1.10 to 1.25. With this, the resulting toner is excellent in all the heat resistant storage stability, low-temperature fixability and hot-offset resistance, and enables excellent glossiness when used in a full color copier. When the toner is used in a two-component developer, the toner has less variation in particle diameter even after toner consumption and toner supply are repeatedly performed for a long period of time, and excellent and stable developing properties can be obtained even after long-term agitation in a developing device. When the toner is used for a one-component developer, the toner has less variation in particle diameter even after toner consumption and toner supply are repeatedly performed for a long time, and the toner exhibits very little forming of films (filming) to developing rollers, very little fusing thereto members such as a blade for making a toner have a thin layer, and excellent and stable developing properties. Therefore, images of excellent quality can be stably obtained even after long-term agitation in a developing device.

Typically, it is said that a toner having a small particle diameter has an advantage in terms of producing high definition and high quality images, but has a disadvantage in terms of transferability and cleanability. When Dv of the toner is smaller than 4 μm, the toner tends to fuse on the surface of the carrier by long-term agitation in a developing device, resulting in degradation of chargeability of the carrier, when the toner is used for a two-component developer. When the toner is used for one-component developer, problems arise such as the toner forming films on developing rollers, and the toner fusing thereto members such as blades for forming thin layers of toner.

In contrast, when Dv of the toner is greater than 8 μm, it is difficult to obtain high definition and high quality images. In addition, an average particle diameter of a toner included in a developer tends to be largely changed when a part of toner particles are replaced with fresh toner particles.

When the ratio Dv/Dn is greater than 1.25, the same phenomena occur. When the ratio Dv/Dn is smaller than 1.10, the toner can be uniformly charged and the toner behavior is stable in an image forming apparatus, but in contrast, the toner cannot be sufficiently electrically charged and cleanability of the toner may degrade.

<Degree of Circularity>

The toner of the present invention preferably has an average circularity degree of 0.94 to 0.96. The circularity can be measured using a flow type particle image analyzer, FPIA-2100 (manufactured by Toa Medical Electronics Co., Ltd.). Specifically, the circularity of toner can be measured as follows. In 100 mL to 150 mL of water, in a vessel, from which impure solid matters are removed in advance, 0.1 mL to 0.5 mL of a surfactant, preferably alkylbenzene sulfonic acid salt is added, and about 0.1 g to about 0.5 g of a measurement sample is further added thereto. A suspension liquid in which the sample has been dispersed is subjected to a dispersion treatment in an ultrasonic disperser for about 1 min to about 3 min so that the resulting dispersion liquid has a concentration of 3,000/μL to 10,000/μL, followed by measuring the shape of the toner using the flow type particle image analyzer.

<Charge Controlling Agent>

The toner of the present invention may contain a charge controlling agent, as required, and it can be selected from known charge controlling agents. Examples of the charge control agent include nigrosin dye, triphenylmethane dye, chrome-containing metal complex dye, moribdate-chelated pigment, rhodamine dye, alkoxy amine, quaternary ammonium salt (including fluoride-modified quaternary ammonium salt), alkylamide, phosphorous or phosphorous-containing compounds, tungsten or tungsten-containing compounds, fluorochemical surfactants, metal salicylate, salicylate derivative metal salts, and the like.

Specific examples of the charge control agent include nigrosin dye BONTRON 03, quaternary ammonium salt BONTRON-P-51, metal-containing azo dye BONTRON S-34, oxynaphthate metal complex E-82, salicylate metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hoechst), LRA-901, boron complex LR-147 (which are produced by Japan Carlit Co., Ltd.), copper phthalocyanine, perylene, quinacridone, azo pigment, and high-molecular-weight compounds having sulfonyl, carboxyl, or quaternary ammonium salt group.

In the present invention, the addition amount of the charge controlling agent is determined depending on the type of binder resin used, presence or absence of additives used according to the necessity, and toner production method including dispersion method, and is not unequivocally defined. However, the addition amount of the charge controlling agent is preferably 0.1% to 10%, more preferably 0.2% to 5% based on the binder resin. When the addition amount of the charge controlling agent is more than 10%, the chargeability of the resulting toner is excessively increased to reduce the effect of the main charge controlling agent and to increase the electrostatic attraction force with a developing roller used, possibly leading to a degradation in flowability of the developer and a degradation in image density. These charge controlling agents may be melt-kneaded with the masterbatch and binder resin and then dissolved and dispersed in an organic solvent, may be directly added in an organic solvent when the masterbatch and binder resin are dissolved and dispersed therein, or may be fixed on a surface of toner.

<External Additives>

As an external additive for further improving the flowability, developing property and chargeability of the toner of the present invention, it is preferable to use an inorganic particle. The inorganic particle preferably has a primary particle diameter of 5 nm to 2 μm, particularly preferably has a primary particle diameter of 5 nm to 500 nm. The inorganic particle preferably has a specific surface area, measured by BET method, of 20 $m^2/g$ to 500 $m^2/g$. The addition amount of the inorganic particle is preferably 0.01% by weight to 5% by weight, particularly preferably 0.01% by weight to 2.0% by weight, based on the amount of toner.

Specific examples of the inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

In addition to the above-mentioned, polymer particles can be added as external additives. Examples of the polymer particles include polystyrenes, methacrylic esters and acrylic ester copolymers obtained by soap-free emulsification polymerization, suspension polymerization, or dispersion polymerization; and polymer particles obtained from a polycondensate resin and a thermosetting resin such as benzoguanamine, and nylon.

Further, by subjecting the resulting toner to surface treatment with a fluidizer, it is possible to increase the hydrophobicity and to prevent degradation of flowability and chargeability of the toner even under high humidity environments. Examples of the fluidizer include silane coupling agent, silylation agents, silane coupling agents having a fluoride alkyl group, organic titanate-based coupling agents, aluminum-based coupling agents, silicone oils and modified silicone oils.

<Other Components>

The other components are not particularly limited and may be suitably selected in accordance with the intended use. Examples of the other components include flowability improvers, cleanability improvers, magnetic materials, and metal soaps.

Examples of the cleanability improver for removing untransferred developer remaining on a photoconductor, a primary transfer medium include fatty acid metal salts such as zinc stearate, and calcium stearate; and polymer particles such as polymethacrylate particle, and polystyrene particle. The polymer particle preferably has a relatively sharp particle size distribution and a volume average particle diameter of 0.01 μm to 1 μm.

(Developer)

The toner of the present invention can also be used as a one-component magnetic toner using no carrier or a non-magnetic toner. Alternatively, it can be used as a two-component developer using a carrier.

<Carrier for Two-Component Developer>

When the toner of the present invention is used in a two-component developer, the toner may be used in a mixture with a magnetic carrier. As the ratio of a magnetic carrier and the toner contained in a two-component developer, the toner is preferably contained in an amount of 1 part by mass to 10 parts by mass per 100 parts by mass of the magnetic carrier. As the magnetic carrier, it is possible to use a known magnetic carrier, such as an iron powder, ferrite powder, magnetite powder, and magnetic resin carrier, each having a particle diameter of about 20 μm to about 200 μm.

In addition, as a coat resin of the magnetic resin, an amino-based resin can be used. Examples thereof include urea-formaldehyde resin, melamine resin, benzoguanamine resin, urea resin, polyamide resin, and epoxy resin. Besides the above-mentioned, it is possible to use polyvinyl and polyvinylidene resins (acrylic resin, polymethacrylate, polyacrylonitrile, polyvinyl acetate, polyvinyl alcohol, polyvinyl butyral, etc.); polystyrenes and polystyrene resins (styrene-acrylic copolymers etc.); halogenated olefin resins (polyvinyl chloride, etc.); polyester-based resins (polyethylene terephthalate, polybutylene terephthalate resin, etc.), polycarbonate resin, polyethylene, polyvinyl fluoride, polyvinylidene fluoride, polytrifluoroethylene, polyhexafluoropropylene, a copolymer of vinylidene fluoride with an acrylic monomer, a copolymer of vinylidene fluoride with vinyl fluoride, fluoroterpolymer (terpolymer of tetrafluoroethylene, vinylidene fluoride with non-fluorine monomer, a silicone resin, and the like.

The coating resin may contain a conductive powder as required. As the conductive powder include metal powder, carbon black, titanium oxide, tin oxide, zinc oxide or the like can be used. These conductive powders preferably have an average particle diameter of 1 μm or smaller. When the conductive powder has an average particle diameter greater than 1 μm, it is difficult to control the electric resistance.

(Toner-Containing Container)

In a toner container of the present invention, a toner according to the present invention is housed. The container is not particularly limited and may be suitably selected from among those known in the art, and for example, there may be exemplified a container having a container main body and a cap.

The container main body is not particularly limited as to the size, shape, structure, material or the like. However, it is preferable that the container main body have a cylindrical shape, and a spirally shaped concave-convex portion be formed on its inner circumferential surface. If the container has such a shape, a developer, which is the content of the container, can be transferred toward the discharge port side when the container is rotated. Particularly preferably, a part of or all of the spirally shaped concave-convex portion or the whole thereof has an accordion function.

The material of the container main body is not particularly limited, may be suitably selected in accordance with the intended use, however, the one having excellent dimensional accuracy is preferable. Examples of the material of the container main body include polyester resins, polyethylene resins, polypropylene resins, polystyrene resins, polyvinyl chloride resins, polyacrylic resins, polycarbonate resins, ABS resins, and polyacetal resins.

The toner container used in the present invention is easily stored and transported, excels in handleability, and can be detachably mounted to the process cartridge, the image forming apparatus of the present invention or the like, which will be described hereinafter, to be suitably used for supply of developer.

(Image Forming Method and Image Forming Apparatus)

The image forming method using a toner according to the present invention preferably includes at least a latent electrostatic image forming step, a developing step, a transferring step, and a fixing step, and more preferably, further includes a cleaning step. The image forming method may include, for example, a charge eliminating step, a recycling step, and a controlling step as required.

Meanwhile, the image forming apparatus of the present invention preferably includes at least a latent electrostatic image bearing member, a latent electrostatic image forming unit, a developing unit, a transfer unit, and a fixing unit, and more preferably, further includes a cleaning unit. The image forming apparatus may include, for example, a charge eliminating unit, a recycling unit, and a controlling unit as required.

The image forming method of the present invention can be carried out by using an image forming apparatus of the present invention. More specifically, the latent electrostatic image forming step can be performed by using the latent electrostatic image forming unit; the developing step can be performed by using the developing unit; the transferring step can be performed by using the transfer unit; the fixing step can be performed by using the fixing unit; and the steps other than these steps can be performed by using the units other than these units.

The latent electrostatic image forming step is a step of forming a latent electrostatic image on a latent electrostatic image bearing member such as a photoconductive insulator, and a photoconductor. The latent electrostatic image bearing member is not particularly limited as to the material, shape, structure, size or the like, and may be suitably selected from among those known in the art. With respect to the shape, drum-shaped one is preferably used. Preferred examples of the material used for the latent electrostatic image bearing member include inorganic photoconductors made from amorphous silicon, selenium, or the like, and organic photoconductors made from polysilane, phthalopolymethine, or the like. Among these materials, a photoconductor made from amorphous silicon or the like is preferably used in terms of longer operating life.

The latent electrostatic image can be formed, for example, by charging the surface of the latent electrostatic image bearing member uniformly and then exposing imagewise the surface thereof by means of the latent electrostatic image forming unit. The latent electrostatic image forming unit includes, for example, at least a charger configured to uniformly charge the surface of the image bearing member by applying a voltage to the surface thereof, and an exposer configured to expose imagewise the surface of the image bearing member.

The charger is not particularly limited, may be suitably selected in accordance with the intended use, and examples thereof include contact chargers known in the art, for example, which are equipped with a conductive or semi-conductive roller, brush, film, rubber blade or the like, and non-contact chargers utilizing corona discharge such as corotron and scorotron.

The exposer is not particularly limited, provided that the surface of the latent electrostatic image bearing member which has been charged by the charger can be exposed imagewise, may be suitably selected in accordance with the intended use, and examples thereof include various types of exposers such as reproducing optical systems, rod lens array systems, laser optical systems, and liquid crystal shutter optical systems. In the present invention, the back light method may be employed in which exposing is performed imagewise from the back side of the image bearing member.

The developing step is a step of developing the latent electrostatic image using a toner of the present invention to form a visible image. The visible image can be formed using the developing unit. The developing unit is not particularly limited, as long as a latent electrostatic image can be developed using the toner of the present invention, and preferred examples thereof include the one having at least an image developing device which houses the toner therein and enables supplying the toner to the latent electrostatic image in contact or in non-contact. An image developing device provided with a developer container of the present invention is more preferable. The image developing device may employ a dry-developing process or a wet-developing process. It may be an image developing device for monochrome color or multicolors. Preferred examples thereof include the one having a stirrer by which a developer of the present invention is frictionally stirred to be charged, and a rotatable magnet roller. In the image developing device, for example, the toner and the carrier are mixed and stirred, the toner is charged by frictional force at that time to be held in a state where the toner is standing on the surface of the rotating magnet roller to thereby form a magnetic brush. Since the magnet roller is disposed near the latent electrostatic image bearing member, a part of the toner constituting the magnetic brush formed on the surface of the magnet roller moves to the surface of the latent electrostatic image bearing member by electric attraction force. As a result, the latent electrostatic image is developed using the toner to form a visible toner image on the surface of the latent electrostatic image bearing member. The developer to be housed in the image developing device is the developer of the present invention, and may be a one-component developer or two-component developer.

The transferring step is a step of transferring the toner image onto a recording medium by charging the latent electrostatic image bearing member having the toner image formed on the surface thereof, by means of a transfer charger. The toner image can be transferred by using the transfer unit. At this time, the transferring step preferably includes a primary transferring step in which a toner image is transferred onto an intermediate transfer member, and a secondary transferring step in which the toner image transferred on the intermediate transfer member is secondarily transferred onto a recording medium. More preferably, the transferring step includes a primary transferring step in which two or more color-toners, preferably, full-color toners are used, individual toner images of color toners are transferred onto an intermediate transfer member to form a composite toner image; and a secondary transferring step in which the composite toner image formed on the intermediate transfer member is transferred onto a recording medium.

The transfer unit preferably includes a primary transfer unit configured to transfer toner images onto the intermediate transfer member to form a composite toner image, and a secondary transfer unit configured to transfer the composite toner image formed on the intermediate transfer member onto a recording medium. The intermediate transfer member is not particularly limited, and, specific examples thereof include an endless transfer belt. The transfer unit (primary transfer unit, secondary transfer unit) preferably includes at least an image-transferer configured to exfoliate the visible image formed on the latent electrostatic image bearing member to be charged and transfer the visible image onto the recording medium. The transfer unit may include one or two or more image-transferers.

Examples of the image transferer include corona image transferers using corona discharge, transfer belts, transfer rollers, pressure transfer rollers, and adhesion image transfer units.

The recording medium is not particularly limited and may be suitably selected from among those known in the art.

The fixing step is a step of fixing a visible image which has been transferred onto a recording medium using a fixing unit. When two or more color toners are used, the image fixing may be performed every time each color toner is transferred onto the recording medium or at a time so that each of individual color toners are superimposed at the same time. The fixing unit is not particularly limited, may be suitably selected in accordance with the intended use, and heat-pressurizing units known in the art are preferably used. Examples of the heat-pressurizing units include a combination of a heat roller and a pressure roller, and a combination of a heat roller, a pressure roller, and an endless belt. The heating temperature in the heat-pressurizing unit is preferably 80° C. to 200° C. In the present invention, for example, an optical fixing device known in the art may be used together with or instead of the fixing unit, if necessary.

The charge eliminating step is a step of eliminating charge by applying a charge-eliminating bias to the image bearing member, and it can be suitably performed by means of a charge-eliminating unit. The charge-eliminating unit is not particularly limited as long as a charge-eliminating bias can be applied to the latent electrostatic image bearing member. For example, a charge-eliminating lamp or the like can be used.

The cleaning step is a step of removing a residual toner remaining on the latent electrostatic image bearing member, and the cleaning can be preferably performed using a cleaning unit. The cleaning unit is not particularly limited, provided that the residual toner remaining on the image bearing member can be removed. As the cleaning unit, for example, a magnetic brush cleaner, an electrostatic brush cleaner, a magnetic roller cleaner, a blade cleaner, a brush cleaner, or a web cleaner can be used.

The recycling step is a step of recycling the toner that had been removed in the cleaning to the developing unit, and the recycling can be suitably performed by means of a recycling unit. The recycling unit is not particularly limited, and examples thereof include conveyance units known in the art.

The controlling is a step of controlling the above-noted individual steps, and the controlling can be suitably performed by means of a controlling unit. The controlling unit is not particularly limited as long as it can control operations of the individual units. For example, sequencers and computers can be used.

An example of the image forming apparatus of the present invention will be described with reference to FIG. 1. An image forming apparatus 100 is provided with a photoconductor drum 10 serving as a latent electrostatic image bearing member, a charge roller 20 serving as a charging unit, an exposer (not illustrated) serving as an exposing unit, an image developing device 45 serving as a developing unit, an intermediate transfer member 50, a cleaner 60 which serves as a cleaning unit and has a cleaning blade, and a charge-eliminating lamp 70 serving as a charge-eliminating unit.

The intermediate transfer member 50 is an endless belt and is designed such that the endless belt is spanned over three rollers 51 which are disposed inside thereof and driven in the direction indicated by the arrow illustrated in the figure. At least one of the three rollers 51 also serves as a bias roller capable of applying a predetermined bias for image transfer (primary transfer bias) to the intermediate transfer member 50.

A cleaner 90 having a cleaning blade is arranged near the intermediate transfer member 50. A transfer roller 80 serving as a transfer unit is arranged so as to face the intermediate transfer member 50 and is capable of applying a bias for image transfer (secondary transferring) for transferring a visible image (toner image) to a recording medium 95.

A corona charger 52 for applying a charge to the toner image on the intermediate transfer member 50 is arranged around the intermediate transfer member 50. The corona charger 52 is disposed between a contact area of the latent electrostatic image bearing member 10 with the intermediate transfer member 50 and another contact area of the intermediate transfer member 50 with the recording medium 95.

The image developing devices 45 of individual colors of black (K), yellow (Y), magenta (M) and cyan (C) are each equipped with a developer holder 42, a developer feed roller 43 and a developing roller 44.

In the image forming apparatus 100, for example, the charge roller 20 uniformly charges the photoconductor drum 10. The photoconductor drum 10 is exposed imagewise to exposure light L by the exposer (not illustrated) to form a latent electrostatic image thereon. Next, the image developing device 45 feeds the toner to the photoconductor drum 10 to develop the electrostatic latent image formed on the photoconductor drum 10 to form a visible image i.e., a toner image. The toner image is transferred to the intermediate transfer member 50 (primary transferring) by action of a transfer bias applied from the rollers 51. Further, an electric charge is applied to the toner image on the intermediate transfer member 50 by the corona charger 52, and the toner image is transferred to the recording sheet 95 (secondary transferring). Untransferred toner on the photoconductor 10 is removed by the cleaner 60, and the residual charge on the photoconductor 10 is removed once by the charge-eliminating lamp 70.

Figure 2:
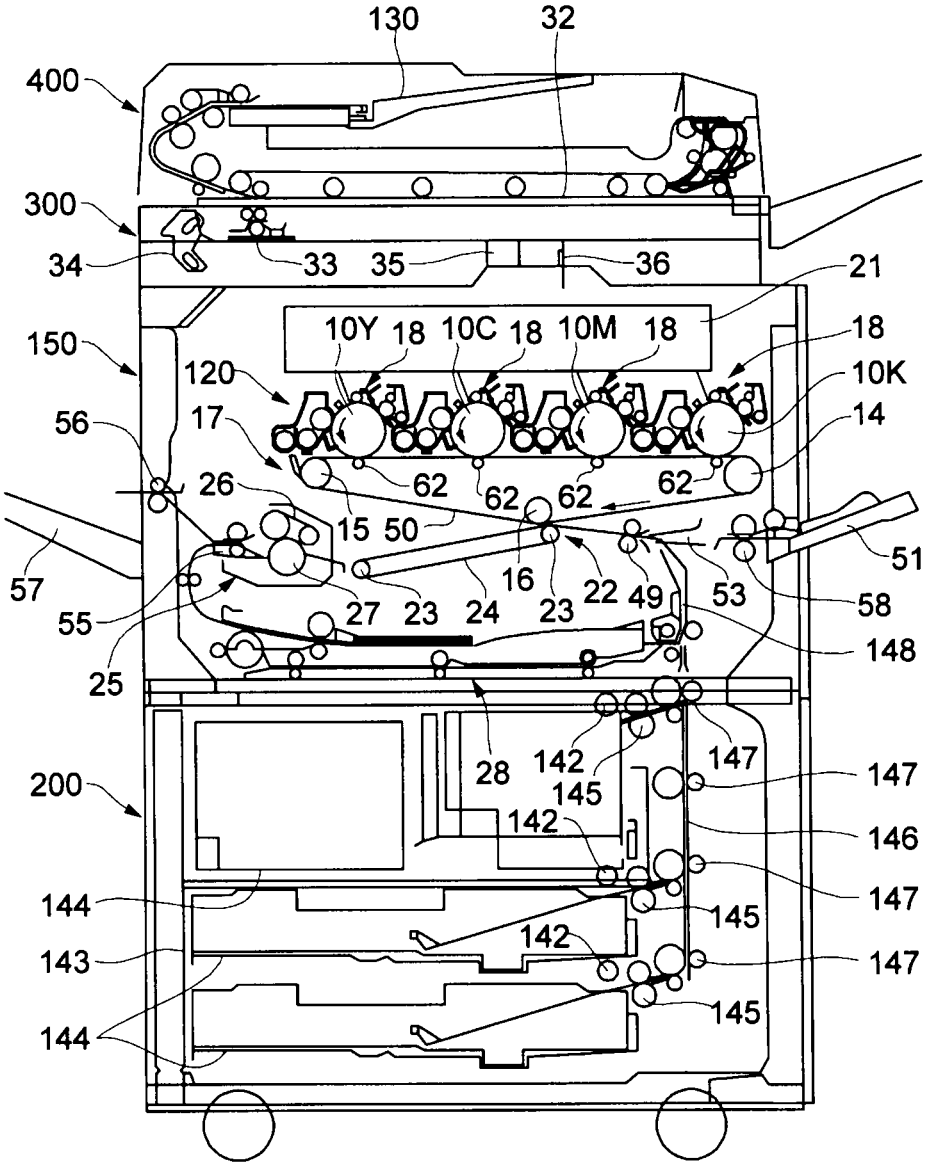
FIG. 2 is a diagram illustrating another example of an image forming apparatus according to the present invention.

Another example of the image forming apparatus of the present invention will be described with reference to FIG. 2. An image forming apparatus in the figure is a tandem type color image forming apparatus and includes a copier main body 150, a sheet-feeder table 200, a scanner 300, and automatic document feeder (ADF) 400.

The copier main body 150 is provided with an intermediate transfer member 50 formed in an endless belt at its center part. The intermediate transfer member 50 is spanned over three support rollers 14, 15, and 16 and is capable of rotating and moving in a clockwise direction in FIG. 2.

An intermediate transfer member cleaner 17 capable of removing a residual toner on the intermediate transfer member 50 is arranged near the support roller 15. Above the intermediate transfer member 50 spanned between the support rollers 14 and 15, four (yellow, cyan, magenta, and black) image forming units 18 are arrayed in parallel in a moving direction of the intermediate transfer member 50 to thereby constitute a tandem image developing device 120.

Figure 3:
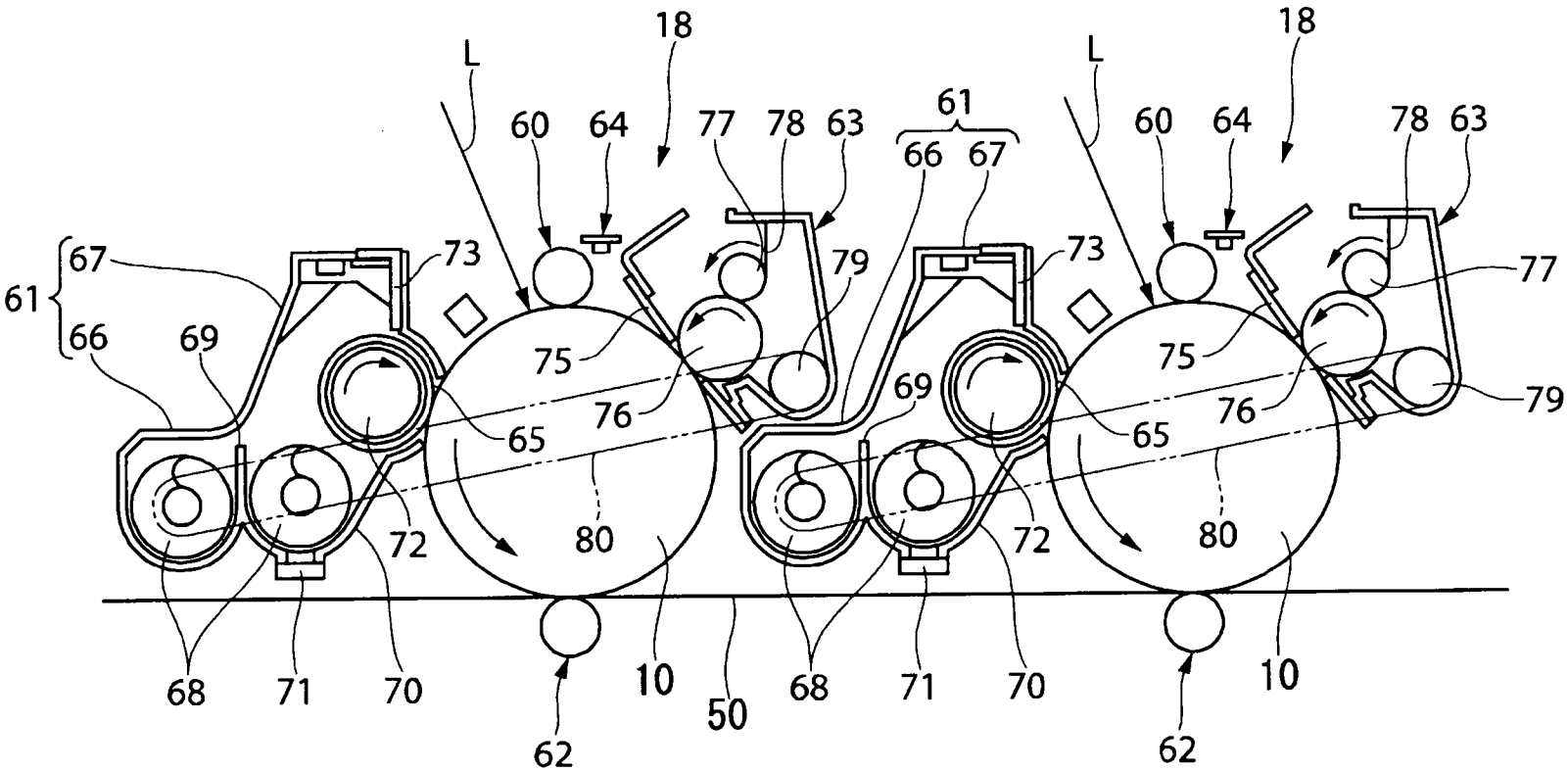
FIG. 3 is a diagram illustrating a tandem type developing device mounted in the image forming apparatus illustrated in FIG. 2.

The image forming units 18 for individual color toners are each provided, as illustrated in FIG. 3, a photoconductor drum 10, a charge roller 20 for uniformly charging the photoconductor drum 10, an image developing device configured to develop latent electrostatic images formed on the photoconductor drum 10 with each color developer of black (K), yellow (Y), magenta (M) and cyan (C) to form a corresponding color toner image, a transfer roller 80 for transferring each of the color toner images onto the intermediate transfer member 50, a cleaner 60, and a charge-eliminating lamp 70.

An exposer 30 is arranged near the tandem type image developing device 120. The exposer 30 exposes exposure light L to the photoconductor drum 10 to form a latent electrostatic image.

A secondary image transferer 22 is arranged to face the tandem image developing device 120 with the interposition of the intermediate transfer member 50. The secondary transferer 22 includes a secondary transfer belt 24 serving as an endless belt spanned over a pair of rollers 23. A recording sheet being transported on the secondary transfer belt 24 is in contact with the intermediate transfer member 50.

A fixing device 25 is arranged on the side of the secondary image transferer 22. The fixing device 25 includes a fixing belt 26 which is an endless belt, and a pressure roller 27 which is arranged so as to be pressed by the fixing belt 26.

The tandem type image forming apparatus is further provided with a sheet reverser 28 in the vicinity of the secondary image transferer 22 and the fixing device 25. The sheet reverser 28 is capable of reversing the recording sheet so as to form images on both sides of the recording sheet.

Next, full-color image forming i.e. color copying using the tandem type image forming apparatus will be described below. First, a document is placed on a document platen 130 of the automatic document feeder (ADF) 400. Alternatively, the automatic document feeder (ADF) 400 is opened, a document is placed on a contact glass 32 of a scanner 300, and the automatic document feeder (ADF) 400 is closed to press the document. When pushing a start switch (not illustrated), the document placed on the automatic document feeder 400 is transported onto the contact glass 32. When the document is initially placed on the contact glass 32, by pushing the start switch (not illustrated), the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image) and to produce black, yellow, magenta, and cyan image information.

Further, based on the obtained image information of individual colors, latent electrostatic images of the individual colors are each formed on the photoconductor drum 10 by the exposer 30, and then the latent electrostatic images of individual colors are developed with developers each supplied from the image developing devices corresponding to the individual colors to thereby form a toner images of the individual colors. The individual color toner images thus formed are sequentially transferred in a superimposed manner onto the intermediate transfer member 50 (primary transferring) which rotationally moves by means of the support rollers 14, 15 and 16, and a composite toner image is formed on the intermediate transfer member 50.

One of feeder rollers 142 in the sheet-feeder table 200 is selectively rotated, recording sheets are ejected from one of multiple feeder cassettes 144 in paper bank 143, are separated by a separation roller 145 one by one, one recording sheet is sent into a feeder path 146, transported by a transport roller 147 into a feeder path 148 in the copier main body 150 and is bumped against a registration roller 49. Alternatively, feeder roller 142 is rotated to eject recording sheets on manual bypass tray 54, the recording sheets are separated one by one by the separation roller 58, and one recording sheet is sent into a manual bypass feeder path 53 and then similarly bumped against the registration roller 49. The registration roller 49 is typically grounded, however, it may be used under application of a bias to remove paper dust of the recording sheets.

The registration roller 49 is rotated in synchronization with the movement of the composite color image i.e. the transferred color image formed on the intermediate transfer member 50 to feed the sheet (recording paper) into between the intermediate transfer member 50 and the secondary image transferer 22, and the composite color image is transferred onto the recording sheet (secondary transferring).

The recording sheet bearing the transferred composite toner image is then transported by the secondary image transferer 22 to be fed into the fixing device 25, applied with heat and pressure in the fixing device 25 by the fixing belt 26 and the pressure roller 27, and the composite color image (color transfer image) is fixed on the recording sheet. Thereafter, the recording sheet changes its direction by action of the switch blade 55, ejected by an ejecting roller 56 to be stacked on output tray 57. Alternatively, the recording sheet changes its direction by action of the switch blade 55 into the sheet reverser 28, turns therein, is transported again to the transfer position, followed by image formation on the back surface of the recording sheet. The recording sheet bearing images on both sides thereof is ejected through the ejecting roller 56 to be stacked on the output tray 57.

Note that a toner remaining on the intermediate transfer member 50 after the transfer of the composite toner image is removed by a cleaner 17.

(Process Cartridge)

A process cartridge according to the present invention is structured so as to be detachably mounted to various image forming apparatuses, and includes at least a latent electrostatic image bearing member which bears a latent electrostatic image and a developing unit configured to develop the latent electrostatic image borne by the latent electrostatic image bearing member using a developer of the present invention to form a toner image. The process cartridge of the present invention may further include other units as required.

The developing unit includes at least a developer housing to house a developer of the present invention, and a developer bearing member which bears the developer housed in the developer housing and transports the developer. The developing unit may further include a regulating member which regulates the thickness of developer borne on the developer bearing member, and the like.

Figure 4:
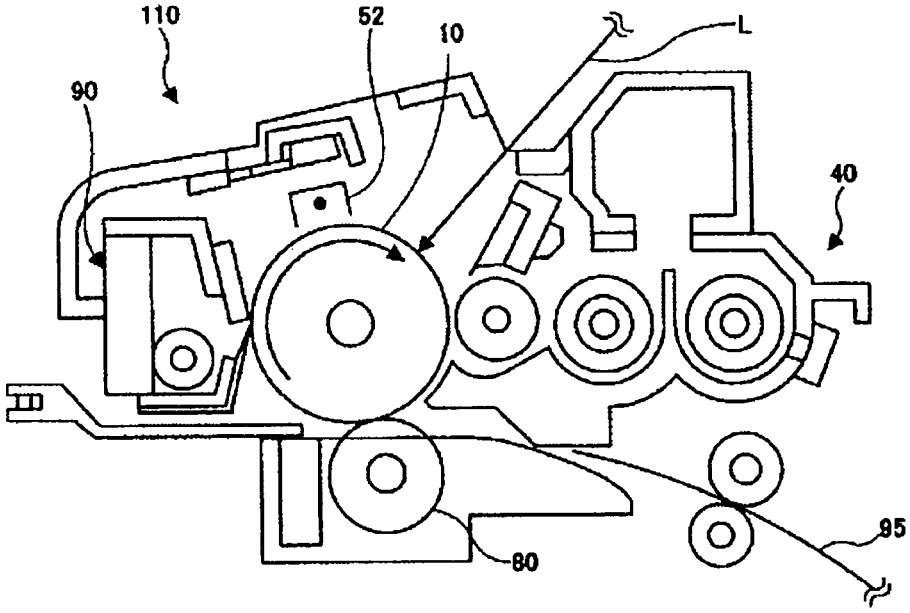
FIG. 4 is a diagram illustrating one example of a process cartridge according to the present invention.

FIG. 4 illustrates one example of a process cartridge according to the present invention. A process cartridge 110 includes a photoconductor drum 10, a corona charger 52, a developing device 40, a transfer roller 80, and a cleaner 90.

EXAMPLES

Hereinafter, a toner of the present invention will be described with reference to Examples, however, the present invention shall not be construed as being limited to these disclosed Examples.

In the following Examples and Comparative Examples, the "Softening Point of Polyester Resin", "Glass Transition Temperature (Tg) of Polyester Resin", "Softening Point of Rosin", "Acid Value of Plyester Resin and Rosin", and "Hydroxyl Value of Polyester Resin" were measured according to the following procedures.

<Measurement of Softening Point of Polyester Resin>

Using Flow Tester (manufactured by Shimadzu Corporation, CFT-500D), 1 g of each polyester-based binder resin as a sample was extruded through a nozzle having a diameter of 1 mm and a length of 1 mm under application of a load of 1.96 MPa from a plunger while heating at a rate of temperature increase of 6° C./min. A fall amount of the plunger in Flow Tester to the temperature was plotted, and the temperature at which a half amount of the sample let out of the nozzle was taken as a softening point.

<Measurement of Glass Transition Temperature (Tg) of Polyester Resin>

Using a differential scanning calorimeter (manufactured by Seiko Electronic Industry Co., Ltd., DSC210), each polyester-based binder resin as a sample was weighed in an amount of 0.01 g to 0.02 g in an aluminum pan. After heating to 200° C., the sample cooled from the same temperature to 0° C. at a rate of temperature decrease of 10° C./min was heated at a rate of temperature increase of 10° C./min, and then the temperature at an intersection point of an extension line of a base line at a temperature lower than an endothermic maximum peak temperature and a tangent line showing a maximum slope from a rising slope of a peak to a peak top was taken as a glass transition temperature.

<Measurement of Softening Point of Rosin>

(1) Preparation of Sample

Rosin (10 g) was melted on a hot plate at 170° C. for 2 hours. Thereafter, in an opening state, the rosin was naturally cooled under an environment of a temperature of 25° C. and a relative humidity of 50% for one hour and then ground by a coffee mill (National MK-61M) for 10 seconds to obtain a sample.

(2) Measurement

Using a Flow Tester (manufactured by Shimadzu Corporation, CFT-500D), 1 g of each polyester-based binder resin as a sample was extruded through a nozzle having a diameter of 1 mm and a length of 1 mm under application of a load of 1.96 MPa from a plunger while heating at a rate of temperature increase of 6° C./min. A fall amount of the plunger in Flow Tester to the temperature was plotted and the temperature at which a half amount of the sample was flowed out was taken as a softening point.

<Acid Value of Polyester Resin and Rosin>

According to the method defined in JIS K0070, an acid value was measured. In the case of only a measurement solvent, a mixed solvent of ethanol and ether defined in JIS K0070 was replaced by a mixed solvent of acetone and toluene (acetone:toluene=1:1 (volume ratio)).

<Hydroxyl Value of Polyester Resin>

A hydroxyl value was measured according to the method defined in JIS K0070.

<Particle Size Distribution>

A weight average particle diameter (Dv) and the number average particle diameter (Dn) in the present invention were measured using a particle size measurement device ("MULTISIZER III" manufactured by Beckman Coulter Co.) with an aperture diameter of 100 μm, followed by analysis with analysis software (Beckman Coulter MULTISIZER 3 Version 3.51). More specifically, in a 100 mL-glass beaker, 0.5 mL of a 10 wt % surfactant (alkylbenzene sulfonic acid salt, NEOGEN SC-A, produced by Dai-ichi Kogyo Seiyaku Co., Ltd.) was added, 0.5 g of each toner was added and mixed with a micro spatula, and then 80 mL of ion exchanged water was added to obtain a dispersion liquid. The dispersion liquid was subjected to a dispersion treatment by an ultrasonic disperser (W-113MK-II, manufactured by Honda Electronics Co., Ltd.) for 10 minutes.

The particle size distribution of the dispersion liquid was measured using the MULTISIZER III and a measurement diluent ISOTON III (produced by Beckman Coulter). In the measurement, the dispersion liquid as a toner sample was delivered by drops so that the concentration indicated by the device was 8%±2%. In this measurement, it is important to maintain the concentration of the dispersion liquid at 8%±2% from the viewpoint of the measurement reproducibility of particle size. If the concentration is within the range, there is no error of measurement. In the measurement, the following 13 channels were used to measure particles having diameters of 2.00 μm or larger and smaller than 40.30 μm; a channel having a diameter of 2.00 μm or larger and smaller than 2.52 μm, a channel having a diameter of 2.52 μm or larger and smaller than 3.17 μm; a channel having a diameter of 3.17 μm or larger and smaller than 4.00 μm; a channel having a diameter of 4.00 μm or larger and smaller than 5.04 μm; a channel having a diameter of 5.04 μm or larger and smaller than 6.35 μm; a channel having a diameter of 6.35 μm or larger and smaller than 8.00 μm; a channel having a diameter of 8.00 μm or larger and smaller than 10.08 μm; a channel having a diameter of 10.08 μm or larger and smaller than 12.70 μM; a channel having a diameter of 12.70 μm or larger and smaller than 16.00 μm; a channel having a diameter of 16.00 μm or larger and smaller than 20.20 μm; a channel having a diameter of 20.20 μm or larger and smaller than 25.40 μm; a channel having a diameter of 25.40 μm or larger and smaller than 32.00 μm; and a channel having a diameter of 32.00 μm or larger and smaller than 40.30 μm. After measuring the volume and the number of toner particles or toner, a volume distribution and a number distribution are calculated. From the obtained distributions, a weight average particle diameter (Dv) and a number average particle diameter (Dn) can be determined. As an indicator of particle size distribution, a ratio Dv/Dn obtained by dividing the weight average particle diameter (Dv) by the number average particle diameter (Dn) is used. If the particles are monodispersed, the value of the ratio is 1. The larger the value of Dv/Dn ratio, the wider the particle distribution is.

<Degree of Circularity>

The degree of circularity of toner can be measured using a flow type particle image analyzer, FPIA-2000 (manufactured by Toa Medical Electronics Co., Ltd.). Specifically, in 100 mL to 150 mL of water, in a vessel, from which impure solid matters are removed in advance, 0.1 mL to 0.5 mL of a surfactant, preferably alkylbenzene sulfonic acid salt is added as a dispersant, and about 0.1 g to about 0.5 g of a measurement sample is further added thereto. A suspension liquid in which the sample has been dispersed is subjected to a dispersion treatment in an ultrasonic disperser for about 1 min to about 3 min so that the resulting dispersion liquid has a concentration of 3,000/μL to 10,000/μL. Then, the degree of circularity of toner can be determined by measuring the shape and distribution of the toner by the flow type particle image analyzer. If the toner has a spherical shape, the degree of circularity is 1.

<Measurement of Chargeability>

(Measurement of Chargeability of Product Under Ordinary Temperature and Ordinary Humidity)

A magnetic carrier (96 parts by mass) with respect to 4 parts by mass of toner base particles was exposed to an environment (temperature/relative humidity) of 20° C./50% for 24 hours, the toner and the carrier were charged into a ball mill under the same environment and mixed by the ball mill for 30 seconds, 10 minutes, and 30 minutes to produce two-component developers which were each stirred under ordinary temperature and ordinary humidity for 30 seconds, for 10 minutes and for 30 minutes. Then, the charged amount of each of the two-component developers was measured by the after-mentioned blow-off method.

It can be said that the closer the charged amount of the two-component developer obtained by stirring for 30 seconds is to that of the two-component developer obtained by stirring for 10 minutes, the more excellent in charge buildability. It can also be said that the closer the charged amount of the two-component developer obtained by stirring for 30 seconds is to that of the two-component developer obtained by stirring for 10 minutes, the more excellent in charge stability.

(Measurement of Chargeability of Product Under High Temperature and High Humidity)

Toner base particles (4 parts by mass) and a magnetic carrier (96 parts by mass) were exposed to an environment (temperature/relative humidity) of 30° C./90% for 24 hours, the toner and the carrier were charged into a ball mill under the same environment and mixed by the ball mill for 10 minutes to produce a two-component developer, followed by measurement of the charged amount thereof by the blow-off method.

It can be said that the smaller the difference in charged amount between the two-component developer obtained by stirring under high temperature and high humidity and the two-component developer obtained by stirring under ordinary temperature and ordinary humidity for 10 minutes, the more excellent in environmental stability.

<Charged Amount: Blow-Off Method>

Each of the developers (6 g) was charged into a metallic cylindrical-shaped container equipped with a stainless steal mesh with sieve opening size of 20 μm at both bottom surfaces thereof, and nitrogen gas was blown into the container to remove only toner. Then, the charged amount of carrier (q) remaining in the container was weighed, and the resulting charged amount (q) was divided by the mass (m) of the toner that had been removed therefrom to determine a resulting value (q/m) as a charged amount.

—Evaluation of Physical Properties—

Next, the toners 1 to 20 produced in Examples and Comparative Examples were evaluated as to the image stability, cleanability, heat resistant storage stability, cold offset resistance, hot offset resistance, smear resistance on developing roller, and odor according to the following manners. The evaluation results are shown in Table 4.

<Image Stability>

Each of the developers was charged in a copier (IMAGIO NEO C285 manufactured by Ricoh Company Ltd.). Using a paper, Type 6000, images each having an image area ratio of 2%, 10%, and 50% were each successively output on 100 sheets under environments (temperature/relative humidity) of 30° C./90% and 10° C./30%, respectively, and then the printed images were evaluated. The results are shown in Table 1. When the image output at $100^{th}$ paper sheet was excellent and equivalent to the initial output images in both of the environments and at any of the image area ratios, the developer was graded as "A". When the image output at $100^{th}$ paper sheet was clearly changed as compared with the initial output images under at least one of the above-mentioned environments and at any of the image area ratios, the developer was graded as "B". Note that when there was less change in the resulting image, the developer was graded as "A". More specifically, a change in image density ΔID≤0.2: A; a change in image density ΔID≤0.3: B; and a change in image density ΔID>0.3: C.

<Cleanability>

Each of the developers was charged in a commercially available copier (IMAGIO NEO C325, manufactured by Ricoh Company Ltd.). An image having an image area ratio of 30% was developed, transferred onto a transfer paper sheet, and the operation of the copier was stopped during a cleaning step where untransferred toner remaining on a surface of the photoconductor was removed with a cleaning blade. The untransferred toner on the surface of the photoconductor that had undergone the cleaning step was transferred onto a white paper sheet with "Scotch tape" (produced by Sumitomo 3M Ltd.) and subjected to measurement of reflection density by a MACBETH reflection densitometer (Model RD514) at 10 places. Then, a difference of the average value from the resulting value measured when the same tape was only attached to the white paper sheet was determined. Then, the evaluation for cleanability was carried out according to the following evaluation criteria. Note that as the cleaning blade, the one that had undergone cleaning after printing of 20,000 sheets was used.

[Evaluation Criteria]

A (Excellent): The difference in reflection density was 0.01 or less.

B (Good): The difference in reflection density was 0.015 or less.

C (Poor): The difference in reflection density was more than 0.015.

<Heat Resistant Storage Stability>

The heat resistant storage stability was measured using a needle penetration tester (manufactured by Nihon Kagaku Engineering K.K.). More specifically, each of the toners was weighed in an amount of 10 g and put in a 30 mL glass vial (screw vial) under an environment of a temperature of 20° C. to 25° C. and a relative humidity of 40% to 60%, and the vial was sealed with a lid. The glass vial containing the toner was tapped 200 times and then left standing in a thermostatic bath maintained at a temperature of 50° C. for 48 hours. Then, a degree of penetration was measured by the needle penetration tester, and the evaluation for heat resistant storage stability was carried out according to the following criteria. The greater the value of degree of penetration is, the more excellent heat resistant storage stability is.

[Evaluation Criteria]

A: The degree of penetration was 30 mm or more.

B: The degree of penetration was 20 mm to 29 mm.

C: The degree of penetration was 15 mm to 19 mm (which is as same as the rates of penetration obtained from conventional toners).

D: The degree of penetration was 8 mm to 14 mm.

E: The degree of penetration was 7 mm or less.

<Cold Offset Resistance>

Each of the developers was charged in a remodeled machine of a super high-speed digital laser printer, IPSIO SP9500 PRO, and a solid image having a size of 1 cm square was formed on a transfer sheet of heavy paper (produced by NBS Ricoh Co., Ltd., copy print paper <135>) with a toner adhesion amount of 0.20 mg/cm$^2$±0.1 mg/cm$^2$. A "Scotch Mending Tape 810" (tape width: 24 mm, produced by Sumitomo 3M Ltd.) was attached on the solid image, and a metal roller (made of SUS; diameter: 50 mm) having a weight of 1 kg was rolled back and forth 10 times over the tape at a rolling speed of 10 mm/s. The tape was peeled off in a predetermined direction at a speed of 10 mm/s, and an image residual ratio was determined from the results of image density before and after the peeling-off of the tape, using the following Equation (ii), and the evaluation for cold offset resistance was carried out according to the following evaluation criteria.

$$\text{Image Residual Ratio (\%)} = (\text{Image density after peeling of tape}/\text{Image density before peeling of tape}) \times 100 \qquad \text{Equation (ii)}$$

[Evaluation Criteria]

A: The image residual ratio was 97% or more.

B: The image residual ratio was 92% or more and less than 97%.

C: The image residual ratio was 85% or more and less than 92%.

D: The image residual ratio was 80% or more and less than 85% (which is as same as the image ratios obtained from conventional toners).

E: The image residual ratio was less than 85%.

<Hot Offset Resistance>

Each of the developers was charged in a remodeled machine of a super high-speed digital laser printer, IPSIO SP9500 PRO, and a solid image having a size of 1 cm square was formed on a transfer sheet of thin paper (produced by NBS Ricoh Co., Ltd., copy print paper <55>) with a toner adhesion amount of 0.40 mg/cm$^2$±0.1 mg/cm$^2$. The image was fixed while varying the fixing roller temperature, and presence or absence of hot offset was visually observed. An upper limit temperature at which no hot offset occurred was determined as an upper limit fixing temperature, and the evaluation for hot offset resistance was carried out according to the following criteria.

[Evaluation Criteria]

A: The upper limit fixing temperature was 240° C. or more.

B: The upper limit fixing temperature was 220° C. or more and less than 240° C.

C: The upper limit fixing temperature was 200° C. or more and less than 220° C.

D: The upper limit fixing temperature was 180° C. or more and less than 200° C. (which is as same as the upper limit fixing temperatures of conventional toners).

E: The upper limit fixing temperature was less than 180° C.

<Smear Resistance on Developing Roller>

Each of the developers was charged in a remodeled machine of a super high-speed digital laser printer, IPSIO SP9500 PRO, and a running printing test of 100,000 sheets was performed using an image chart having an image area ratio of 5%. After the running printing test, the developer and toner on the developing roller were removed therefrom, and the evaluation for smear resistance on developer roller was carried out by visually observing smear on the surface of the developing roller in the paper passing section.

[Evaluation Criteria]

A: No smear observed on the developing roller.

B: A slight amount of smear occurred, but it was difficult to visually distinguish.

C: A small amount of smear occurred.

D: A considerable smear occurred (which is on the substantially same level as those of conventional toners).

E: A considerable smear occurred and it was difficult to put into practical use.

<Evaluation Method for Odor of Toner>

Each of the toners was weighed in an amount of 20 g in an aluminum cup, the cup was left standing for 30 minutes on a hot plate which was heated at 150° C., and odor generated from the toner was evaluated according to the following evaluation criteria.

[Evaluation Criteria]

A: No odor wad detected.

B: Almost no odor wad detected.

C: Odor was slightly detected, but no problem in practical use.

D: Strong odor was detected.

Synthesis Example

Purification Example of Rosin

In a 2,000 mL volumetric distilling flask equipped with a fractionating column, a reflux condenser and a receiver, 1,000 g of a tall rosin was added, followed by distillation under reduced pressure of 1 kPa to collect a distillate at 195° C. to 250° C. as a main fraction. Hereinafter, a tall rosin subjected to purification is referred to as an unpurified rosin, and a rosin collected as a main fraction is referred to as a purified rosin.

Each rosin (20 g) was ground by a coffee mill (National MK-61M) for 5 seconds and passed through a sieve having a sieve opening size of 1 mm, and then the rosin powder was weighed in an amount of 0.5 g in a head space vial (20 mL). After sampling a head space gas, impurities in the unpurified rosin and in the purified rosin were analyzed by a head space GC-MS method, according to the manner described below. The results are shown in Table 1.

<Measuring Conditions of Head Space GC-MS Method>

A. Head Space Sampler (Manufactured by Agilent Co., HP7694)

Sample temperature: 200° C.

Loop temperature: 200° C.

Transfer line temperature: 200° C.

Sample heat balance time: 30 min

Vial pressure gas: helium (He)

Vial pressure time: 0.3 min

Loop filling time: 0.03 min

Loop equilibrium time: 0.3 min

Injection time: 1 min

B. GC (Gas Chromatography) (Manufactured by Agilent Co., HP6890)

Analytic column: DB-1 (60 m-320 μm-5 μm)
Carrier: helium (He)
Flow conditions: 1 mL/min
Injection inlet temperature: 210° C.
Column head pressure: 34.2 kPa
Injection mode: split
Split ratio: 10:1
Oven temperature conditions: 45° C. (3 min)-10° C./min-280° C. (15 min)

C. MS (Mass Spectrometry) (Manufactured by Agilent Co., HP5973)

Ionization method: EI (electron impact) method
Interface temperature: 280° C.
Ion source temperature: 230° C.
Quadrupole temperature: 150° C.

t-butyl catechol were added, the temperature of the components was increased from 160° C. to 200° C. over 2 hours, the components were reacted at 200° C. for 2 hours, and then the reactant was further subjected to distillation under reduced pressure of 5.3 kPa to obtain a fumaric acid-modified rosin.

—Synthesis of Maleic Acid-Modified Rosin—

In a 10 L volumetric flask equipped with a fractionating column, a reflux condenser and a receiver, 6,084 g (18 mol) of a purified rosin and 1,323 g (13.5 mol) of a maleic anhydride were added, the temperature of the components was increased from 160° C. to 220° C. over 8 hours, the components were reacted at 220° C. for 2 hours, and then, the reactant was further subjected to distillation at 220° C. under reduced pressure of 5.3 kPa to obtain a maleic acid-modified rosin.

TABLE 1

| | hexanoic acid | pentanoic acid | benzaldehyde | n-hexanal | 2-benzylfuran | Softening point (° C.) | Acid value (mgKOH/g) |
|---|---|---|---|---|---|---|---|
| Unpurified rosin | $0.9 \times 10^7$ | $0.6 \times 10^7$ | $0.6 \times 10^7$ | $1.8 \times 10^7$ | $1.0 \times 10^7$ | 74.2 | 169 |
| Purified rosin | $0.4 \times 10^7$ | $0.2 \times 10^7$ | $0.2 \times 10^7$ | $1.4 \times 10^7$ | $0.6 \times 10^7$ | 75.0 | 167 |

—Synthesis of Acrylic Acid-Modified Rosin—

In a 10 L volumetric flask equipped with a fractionating column, a reflux condenser and a receiver, 6,084 g (18 mol) of a purified rosin and 907.9 g (12.6 mol) of an acrylic acid were added, the temperature of the components was increased from 160° C. to 220° C. over 8 hours, the components were reacted at 220° C. for 2 hours, and then the reactant was further subjected to distillation under reduced pressure of 5.3 kPa to obtain an acrylic acid-modified rosin.

—Synthesis of Fumaric Acid-Modified Rosin—

In a 10 L volumetric flask equipped with a fractionating column, a reflux condenser and a receiver, 5,408 g (16 mol) of a purified rosin, 928 g (8 mol) of a fumaric acid and 0.4 g of Synthesis Examples 1 to 7

An alcohol component, a carboxylic acid component other than trimellitic anhydride, and an esterifying catalyst shown in Table 2 were charged in a 5 litter volumetric four-necked flask equipped with a nitrogen inlet tube, a dewatering tube, a stirrer and a thermocouple, subjected to a polycondensation reaction under a nitrogen atmosphere at 230° C. for 10 hours, and further reacted at 230° C. under 8.0 kPa for one hour. After cooling to 220° C., trimellitic anhydride was charged thereto, and the reactant was reacted under a normal pressure for one hour, and then further reacted at 220° C. under 20 kPa until the temperature of the reactant reached a desired softening point, thereby obtaining a polyester.

TABLE 2

| | | Synthesis Example | | | | | | |
|---|---|---|---|---|---|---|---|---|
| | | 1 | 2 | 3 | 4 | 5 | 6 | 7 |
| Alcohol component | 1,2-propanediol | 889 g | 889 g | 889 g | 1,254 g | 740 g | 721 g | 1,064 g |
| | 1,3-propanediol | 258 g | 258 g | 258 g | — | — | — | — |
| | 1,4-butanediol | — | — | — | — | 252 g | — | — |
| | BPA-PO* | — | — | — | — | — | 882 g | — |
| | glycerin | 166 g | 166 g | 166 g | — | 135 g | — | — |
| | mol % of 1,2-propanediol in dihydric alcohol component | 77.5 | 77.5 | 77.5 | 100 | 77.7 | 78.7 | 100 |
| Carboxylic acid component | terephthalic acid | 2,108 g | 2,108 g | 2,108 g | 2,054 g | 1,809 g | 1,195 g | 1,720 g |
| | trimellitic anhydride | 307 g | 307 g | 307 g | 380 g | 100 g | 277 g | 54 g |
| | unpurified rosin | — | — | — | — | — | — | 1,027 g |
| | acrylic acid-modified rosin | 764 g | — | — | 252 g | 878 g | 932 g | — |
| | fumaric acid-modified rosin | — | 580 g | — | — | — | — | — |
| | maleic acid-modified rosin | — | — | 580 g | — | — | — | — |
| Esterifying catalyst | Butyl tin oxide | — | — | — | 15 g | — | — | — |
| | tin (II) 2-ethylhexanoate | 20 g | 20 g | 20 g | — | — | 20 g | 20 g |
| | titanium diisopropylate bis(triethanol aminate) | — | — | — | — | 25 g | — | — |
| Physical properties of polyester | Acid value (mgKOH/g) | 26.4 | 27.8 | 27.6 | 56.1 | 51.2 | 27.8 | 28.4 |
| | Hydroxyl value (mgKOH/g) | 18.8 | 25.2 | 25.0 | 39.6 | 22.5 | 20.3 | 21.2 |
| | Softening point (° C.) | 120.7 | 138.9 | 137.3 | 102.9 | 120.5 | 112.2 | 105.9 |
| | Glass transition temperature (° C.) | 68.1 | 65.2 | 64.9 | 59.4 | 61.5 | 62.5 | 54.9 |

Unpurified rosin: unmodified rosin
BPA-PO: propylene oxide adduct of bisphenol A; polyoxypropylene(2.2)-2,2-bis(4-hydroxyphenyl)propane (Preparation of Styrene-Methacrylic Acid Copolymer Resin Particle Dispersion Liquid)

In a reaction vessel equipped with a stirrer and a thermometer, 683 parts by mass of water, 11 parts by mass of sodium salt of methacrylic acid ethylene oxide adduct sulfate (ELEMINOL RS-30; produced by Sanyo Chemical Industries Ltd.), 139 parts by mass of styrene, 138 parts by mass of methacrylic acid and 1 part by mass of ammonium persulfate were charged and stirred at 400 rpm for 15 minutes to obtain a white emulsion. The emulsion was heated to increase the temperature of the system to 75° C. and reacted for 5 hours. Further, 30 parts by mass of a 1% ammonium persulfate aqueous solution were added to the system, the system was aged at 75° C. for 5 hours to thereby obtain an aqueous dispersion liquid (resin particle dispersion liquid A2) of vinyl-based resin (a copolymer of styrene, methacrylic acid and sodium salt of methacrylic acid ethylene oxide adduct sulfate). The volume average particle diameter of the resin particle dispersion liquid A2 was measured by a laser type particle size distribution analyzer LA-920 and found to be 0.15 μm. Next, a part of the resin particle dispersion liquid A2 was dried to isolate the resin component therefrom. The resultant resin component was found to have a glass transition temperature (Tg) of 154° C.

Water (784 parts by mass), 136 parts by mass of the resin particle dispersion liquid A2, and 80 parts by mass of a 48.5% aqueous solution of sodium dodecyldiphenyl ether disulfonate (ELEMINOL MON-7, produced by Sanyo Chemical Industries Ltd.) were mixed and stirred to obtain a milky white liquid (a resin particle dispersion liquid).

(Preparation of Polyester Resin Solutions 1 to 7)

Each of the polyesters obtained in Synthesis Examples 1 to 7 (1,000 parts by mass) was dissolved in 2,000 parts by mass of ethyl acetate and mixed to obtain polyester resin solutions 1 to 7.

(Synthesis of Polyester Prepolymer 1)

In a reaction vessel equipped with a stirrer and a thermometer, 2,000 parts by mass of a polyester resin having a hydroxyl value of 56 mgKOH/g (synthesized by dehydration condensation of 1,2-propanediol and an acrylic acid-modified rosin) were charged, heated to 110° C. under reduced pressure of 3 mmHg and dehydrated for 1 hour. Subsequently, 457 parts by mass of isophorone diisocyanate (IPDI) were charged into the vessel, and a reaction was performed at 110° C. for 10 hours to thereby obtain polyester prepolymer 1 having an isocyanate group at its end. The free isocyanate content of the polyester prepolymer 1 was 3.6%.

(Synthesis of Polyester Prepolymer 2)

In a reaction vessel equipped with a stirrer and a thermometer, 2,000 parts by mass of a polyester resin having a hydroxyl value of 53 mgKOH/g (synthesized by dehydration condensation of 1,2-propanediol and a fumaric acid-modified rosin) were charged, heated to 110° C. under reduced pressure of 3 mmHg and dehydrated for 1 hour. Subsequently, 457 parts by mass of isophorone diisocyanate (IPDI) were charged into the vessel, and a reaction was performed at 110° C. for 10 hours to thereby obtain polyester prepolymer 2 having an isocyanate group at its end. The free isocyanate content of the polyester prepolymer 2 was 3.8%.

(Synthesis of Polyester Prepolymer 3)

In a reaction vessel equipped with a stirrer and a thermometer, 2,000 parts by mass of a polyester resin having a hydroxyl value of 54 mgKOH/g (synthesized by dehydration condensation of 1,2-propanediol and a maleic acid-modified rosin) were charged, heated to 110° C. under reduced pressure of 3 mmHg and dehydrated for 1 hour. Subsequently, 457 parts by mass of isophorone diisocyanate (IPDI) were charged into the vessel, and a reaction was performed at 110° C. for 10 hours to thereby obtain polyester prepolymer 3 having an isocyanate group at its end. The free isocyanate content of the polyester prepolymer 3 was 3.7%.

(Synthesis of Polyester Prepolymer 4)

In a reaction vessel equipped with a stirrer and a thermometer, 2,000 parts by mass of a polyester resin having a hydroxyl value of 55 mgKOH/g (synthesized by dehydration condensation of EO (2 mol) adduct of bisphenol A and a terephthalic acid) were charged, heated to 110° C. under reduced pressure of 3 mmHg and dehydrated for 1 hour. Subsequently, 457 parts by mass of isophorone diisocyanate (IPDI) were charged into the vessel, and a reaction was performed at 110° C. for 10 hours to thereby obtain polyester prepolymer 4 having an isocyanate group at its end. The free isocyanate content of the polyester prepolymer 4 was 3.7%.

(Synthesis of Polyester Prepolymer 5)

In a reaction vessel equipped with a stirrer and a thermometer, 2,000 parts by mass of a polyester resin having a hydroxyl value of 58 mgKOH/g (synthesized by dehydration condensation of 1,2-propanediol, terephthalic acid and an unpurified rosin) were charged, heated to 110° C. under reduced pressure of 3 mmHg and dehydrated for 1 hour. Subsequently, 457 parts by mass of isophorone diisocyanate (IPDI) were charged into the vessel, and a reaction was performed at 110° C. for 10 hours to thereby obtain polyester prepolymer 5 having an isocyanate group at its end. The free isocyanate content of the polyester prepolymer 5 was 3.9%.

(Synthesis of Curing Agent)

In a reaction vessel equipped with a stirrer and a thermometer, 50 parts by mass of ethylene diamine and 50 parts by mass of methyl isobutyl ketone (MIBK) were charged, and a reaction was performed at 50° C. for 5 hours to obtain a ketimine compound (a curing agent).

Example 1

In a beaker, 240 parts by mass of the polyester resin solution 1, 5 parts by mass of carnauba wax (releasing agent) and 4 parts by mass of copper phthalocyanine (colorant) were charged and stirred at 50° C. at 12,000 rpm using a TK homomixer (manufactured by PRIMIX Corporation) so as to be uniformly dispersed, thereby obtaining colorant dispersion liquid 1. In a beaker, 500 parts by mass of ion exchanged water, 500 parts by mass of the resin particle dispersion liquid and 0.2 parts by mass of sodium dodecylbenzene sulfonate were charged and uniformly dissolved. Next, the temperature of the components was increased to 50° C., 300 parts by mass of the colorant dispersion liquid 1 were charged while stirring at 12,000 rpm using a TK homomixer, and stirred for 10 minutes. Next, the resultant mixture liquid was transferred to a kolben equipped with a stirrer and a thermometer, and the temperature of the mixture liquid was increased to distil away the ethyl acetate, so that a colorant particle dispersion liquid was obtained. Next, the colorant particle dispersion liquid was filtered and dried to obtain a colorant particle. The resultant colorant particle (100 parts by mass), 0.7 parts by mass of a hydrophobized silica and 0.3 parts by mass of a hydrophobized titanium oxide were mixed using a HENSCHEL MIXER to thereby obtain Toner 1.

Example 2

Toner 2 was obtained in the same manner as in Example 1, except that the polyester resin solution 1 of Example 1 was changed to the polyester resin solution 2.

Example 3

Toner 3 was obtained in the same manner as in Example 1, except that the polyester resin solution 1 of Example 1 was changed to the polyester resin solution 3.

Example 4

Toner 4 was obtained in the same manner as in Example 1, except that the polyester resin solution 1 of Example 1 was changed to the polyester resin solution 4.

Example 5

Toner 5 was obtained in the same manner as in Example 1, except that the polyester resin solution 1 of Example 1 was changed to the polyester resin solution 5.

Example 6

In a beaker, 240 parts by mass of the polyester resin solution 1, 20 parts by mass of the polyester prepolymer 1, 40 parts by mass of ethyl acetate, 5 parts by mass of carnauba wax (releasing agent) and 4 parts by mass of copper phthalocyanine (colorant) were charged and stirred at 50° C. at 12,000 rpm using a TK homomixer (manufactured by PRIMIX Corporation) so as to be uniformly dispersed, thereby obtaining colorant dispersion liquid 2. In a beaker, 500 parts by mass of the resin particle dispersion liquid were charged, and the temperature thereof was increased to 50° C., and a mixture liquid prepared by mixing 1 part by mass of the curing agent and 214 parts by mass of the colorant dispersion liquid 2 immediately before use was charged while stirring at 12,000 rpm using a TK homomixer, and stirred for 10 minutes. Next, the resultant mixture liquid was transferred to a kolben equipped with a stirrer and a thermometer, the temperature of the mixture liquid was increased to distil away the ethyl acetate, the temperature thereof was further increased to 98° C., and a reaction was performed for 5 hours, so that a colorant particle dispersion liquid was obtained.

In 100 parts by mass of the colorant particle dispersion liquid, 100 parts by mass of a 5% sodium hydroxide aqueous solution were added, stirred at 40° C., 12,000 rpm for 10 minutes using a TK homomixer so as to melt resin particles adhered on surfaces of colorant particles. Next, a supernatant fluid in the mixture liquid was removed by centrifugal separation, and 100 parts by mass of water was further added thereto. After this process was repeated twice, the mixture liquid was dried to obtain a colorant particle. The thus obtained colorant particle (100 parts by mass), 0.7 parts by mass of a hydrophobized silica, and 0.3 parts by mass of a hydrophobized titanium oxide were mixed using a HENSCHEL MIXER to thereby obtain Toner 6.

Example 7

Toner 7 was obtained in the same manner as in Example 6, except that the polyester resin solution 2 and the polyester prepolymer 2 were used instead of the polyester resin solution 1 and polyester prepolymer 1 of Example 6.

Example 8

Toner 8 was obtained in the same manner as in Example 6, except that the polyester resin solution 3 and the polyester prepolymer 3 were used instead of the polyester resin solution 1 and polyester prepolymer 1 of Example 6.

Example 9

Toner 9 was obtained in the same manner as in Example 6, except that the polyester resin solution 4 was used instead of the polyester resin solution 1 of Example 6.

Example 10

Toner 10 was obtained in the same manner as in Example 6, except that the polyester resin solution 4 and the polyester prepolymer 2 were used instead of the polyester resin solution 1 and polyester prepolymer 1 of Example 6.

Example 11

Toner 11 was obtained in the same manner as in Example 6, except that the polyester resin solution 4 and the polyester prepolymer 3 were used instead of the polyester resin solution 1 and polyester prepolymer 1 of Example 6.

Example 12

Toner 12 was obtained in the same manner as in Example 1, except that the polyester resin solution 1 of Example 1 was changed to the polyester resin solution 6.

Example 13

Toner 13 was obtained in the same manner as in Example 6, except that the polyester resin solution 6 was used instead of the polyester resin solution 1 of Example 6.

Comparative Example 1

Toner 14 was obtained in the same manner as in Example 1, except that the polyester resin solution 1 of Example 1 was changed to the polyester resin solution 7.

Comparative Example 2

Toner 15 was obtained in the same manner as in Example 6, except that the polyester resin solution 7 was used instead of the polyester resin solution 1 of Example 6.

Comparative Example 3

Toner 16 was obtained in the same manner as in Example 6, except that the polyester resin solution 4 and the polyester prepolymer 4 were used instead of the polyester resin solution 1 and polyester prepolymer 1 of Example 6.

Comparative Example 4

Toner 17 was obtained in the same manner as in Example 6, except that the polyester resin solution 4 and the polyester prepolymer 5 were used instead of the polyester resin solution 1 and polyester prepolymer 1 of Example 6.

Comparative Example 5

The polyester resin of Synthesis Example 1 (100 parts by mass) shown in Table 2, 5 parts by mass of a carnauba wax (releasing agent) and 4 parts by mass of copper phthalocyanine (colorant) were premixed using a HENSCHEL MIXER (FM10B, manufactured by Mitsui Miike Kakouki Co., Ltd.), and then melt-kneaded at a temperature of 100° C. to 130° C. by a biaxial kneader (PCM-30, manufactured by IKEGAI, LTD.). The thus obtained kneaded product was cooled to room temperature and then coarsely crushed into a particle size of 200 μm to 300 μm by a hammer mill. Next, the crushed product was finely pulverized using a supersonic jet pulverizer LABOJET (manufactured by Nihon Pneumatic Industry Co., Ltd.) while appropriately adjusting the pulverization air pressure so as to have a mass average particle size of 6.2 μm±0.3 μm, and then classified by an air classifier (MDS-I, manufactured by Nihon Pneumatic Industry Co., Ltd.) while appropriately adjusting its louver opening so that the mass average particle diameter was 7.0 μm±0.2 μm and the amount of fine powder particles having particle diameters of 4 μm or smaller was 10% by number or less, and thus a colorant particle was obtained. The thus obtained colorant particle (100 parts by mass), 0.7 parts by mass of a hydrophobic silica and 0.3 parts by mass of a hydrophobized titanium oxide were mixed using a HENSCHEL MIXER to thereby produce Toner 18.

The evaluation results of Toners 1 to 18 described in Examples and Comparative Examples are shown in Tables 3 and 4.

What is claimed is:

1. An electrostatic image developing toner comprising:

a resin fine particle, and a toner material containing a polyester-based resin, and a tin (II) 2-ethylhexanoate, wherein the electrostatic image developing toner is obtained by dissolving and/or dispersing the toner material containing the polyester-based resin in an organic solvent to prepare a toner material liquid, and dispersing the toner material liquid in an aqueous solvent containing the resin fine particle, wherein the polyester-based resin contains a polyester resin obtained by polycondensation of an alcohol component with a carboxylic acid component containing a modified purified-rosin, wherein the modified purified-rosin is a purified rosin which is modified with at least one of a fumaric acid and a maleic acid, and

TABLE 3

| | Toner | Dv (μm) | Dv/Dn | Degree of circularity | Charged amount/30 sec (μC/g) | Charged amount/10 min (μC/g) | Charged amount/30 min (μC/g) | Charged amount under high temperature-high humidity environment (μC/g) |
|---|---|---|---|---|---|---|---|---|
| Ex. 1 | Toner 1 | 6.6 | 1.15 | 0.95 | −30.5 | −33.9 | −33.5 | −29.8 |
| Ex. 2 | Toner 2 | 6.4 | 1.17 | 0.96 | −32.3 | −34.5 | −35.3 | −30.8 |
| Ex. 3 | Toner 3 | 6.8 | 1.16 | 0.95 | −33.6 | −35.6 | −34.9 | −31.4 |
| Ex. 4 | Toner 4 | 6.7 | 1.17 | 0.96 | −34.8 | −37.4 | −36.8 | −30.8 |
| Ex. 5 | Toner 5 | 6.6 | 1.16 | 0.95 | −33.9 | −35.5 | −34.8 | −30.2 |
| Ex. 6 | Toner 6 | 6.8 | 1.19 | 0.95 | −30.3 | −32.5 | −33.7 | −28.8 |
| Ex. 7 | Toner 7 | 6.5 | 1.16 | 0.96 | −31.5 | −33.2 | −34.8 | −28.5 |
| Ex. 8 | Toner 8 | 6.4 | 1.15 | 0.95 | −32.6 | −34.9 | −33.8 | −27.7 |
| Ex. 9 | Toner 9 | 6.8 | 1.16 | 0.96 | −31.5 | −32.8 | −33.4 | −30.8 |
| Ex. 10 | Toner 10 | 6.2 | 1.19 | 0.96 | −30.8 | −32.2 | −33.1 | −26.8 |
| Ex. 11 | Toner 11 | 6.3 | 1.18 | 0.96 | −31.4 | −31.9 | −32.9 | −27.4 |
| Ex. 12 | Toner 12 | 6.7 | 1.16 | 0.96 | −39.7 | −42.3 | −38.5 | −38.9 |
| Ex. 13 | Toner 14 | 6.7 | 1.16 | 0.96 | −38.5 | −41.9 | −38.4 | −37.5 |
| Comp. Ex. 1 | Toner 13 | 6.2 | 1.16 | 0.96 | −10.1 | −18.2 | −21.3 | −5.9 |
| Comp. Ex. 2 | Toner 15 | 6.1 | 1.15 | 0.97 | −15.8 | −23.2 | −24.3 | −10.9 |
| Comp. Ex. 3 | Toner 16 | 6.2 | 1.17 | 0.95 | −37.8 | −41.4 | −37.2 | −36.4 |
| Comp. Ex. 4 | Toner 17 | 6.3 | 1.16 | 0.95 | −20.3 | −28.7 | −26.4 | −17.9 |
| Comp. Ex. 5 | Toner 18 | 7.1 | 1.24 | 0.94 | −27.3 | −28.4 | −30.3 | −25.2 |

TABLE 4

| | Toner | Image stability | Cleanability | Heat resistant storage stability | Cold offset resistance | Hot offset resistance | Smear resistance on developing roller | Odor |
|---|---|---|---|---|---|---|---|---|
| Ex. 1 | Toner 1 | A | A | A | B | A | A | A |
| Ex. 2 | Toner 2 | A | B | A | A | A | B | A |
| Ex. 3 | Toner 3 | A | A | B | A | A | B | A |
| Ex. 4 | Toner 4 | A | B | B | A | B | B | A |
| Ex. 5 | Toner 5 | A | A | A | A | A | B | A |
| Ex. 6 | Toner 6 | A | A | A | B | A | A | A |
| Ex. 7 | Toner 7 | B | B | A | B | A | A | A |
| Ex. 8 | Toner 8 | B | A | A | B | A | A | A |
| Ex. 9 | Toner 9 | A | B | A | A | B | B | A |
| Ex. 10 | Toner 10 | B | B | A | A | B | B | A |
| Ex. 11 | Toner 11 | B | B | A | A | B | B | A |
| Ex. 12 | Toner 12 | A | B | A | B | A | A | A |
| Ex. 13 | Toner 13 | B | B | A | B | A | A | A |
| Comp. Ex. 1 | Toner 14 | C | B | D | A | D | D | D |
| Comp. Ex. 2 | Toner 15 | C | B | D | A | D | D | D |
| Comp. Ex. 3 | Toner 16 | B | A | A | D | A | A | A |
| Comp. Ex. 4 | Toner 17 | C | A | D | A | C | C | D |
| Comp. Ex. 5 | Toner 18 | C | A | D | A | D | D | A |

wherein the alcohol component comprises 1,2-propanediol and 1,3-propanediol and wherein the molar ratio of 1,2-propanediol to 1,3-propanediol (1,2-propanediol/1,3-propanediol) is 78/22 to 65/35.

2. The electrostatic image developing toner according to claim 1, wherein the alcohol component contains 1,2-propanediol in an amount of 65 mol % or more in a dihydric alcohol component.

3. The electrostatic image developing toner according to claim 1, wherein the alcohol component contains 1,2-propanediol in an amount of 90 mol % or more in a dihydric alcohol component.

4. The electrostatic image developing toner according to claim 1, wherein the toner material further contains at least one of a releasing agent and a colorant.

5. The electrostatic image developing toner according to claim 4, wherein the releasing agent is a carnauba wax.

6. The electrostatic image developing toner according to claim 4, wherein the colorant is a copper phthalocyanine.

7. The electrostatic image developing toner according to claim 1, wherein part of the polyester-based resin in a composition containing the polyester-based resin is a functional group-containing-polyester-based resin; and the toner is formed of a dispersion liquid which is obtained by dispersing a phase of the organic solvent in which the polyester-based resin has been dissolved, an active hydrogen containing compound and a colorant in an aqueous medium in which the resin fine particle has been dispersed to effect an elongation reaction and/or a crosslinking reaction of the functional group-containing-polyester-based resin with the active hydrogen containing compound.

8. The electrostatic image developing toner according to claim 7, wherein the functional group-containing-polyester-based resin contains an isocyanate group as a functional group.

9. The electrostatic image developing toner according to claim 1, wherein the degree of circularity of the toner is in the range of 0.94 to 0.98.

10. The electrostatic image developing toner according to claim 1, wherein the degree of circularity of the toner is in the range of 0.95 to 0.96.

11. The electrostatic image developing toner according to claim 1, wherein the volume average particle diameter of the toner is 3 μm to 8 μm.

12. The electrostatic image developing toner according to claim 1, wherein the volume average particle diameter of the toner is 6.2 μm to 6.8 μm.

13. The electrostatic image developing toner according to claim 1, wherein a ratio (Dv/Dn) of the volume average particle diameter (Dv) to a number average particle diameter (Dn) of the toner is 1.25 or less.

14. The electrostatic image developing toner according to claim 1, wherein a ratio (Dv/Dn) of the volume average particle diameter (Dv) to a number average particle diameter (Dn) of the toner is 1.19 or less.

15. A two-component developer comprising:

the electrostatic image developing toner of claim 1, and a carrier which comprises magnetic particles.

16. A process cartridge comprising:

a latent electrostatic image bearing member, and a developing unit configured to develop a latent electrostatic image formed on the latent electrostatic image bearing member using a toner to form a visible image, wherein the process cartridge is detachably mounted to a main body of an image forming apparatus, wherein the toner is an electrostatic image developing toner which comprises a resin fine particle and a toner material containing a polyester-based resin, and which is obtained by dissolving and/or dispersing the toner material containing the polyester-based resin in an organic solvent to prepare a toner material liquid, and dispersing the toner material liquid in an aqueous solvent containing the resin fine particle, and wherein the polyester-based resin contains a polyester resin obtained by polycondensation of an alcohol component with a carboxylic acid component containing a modified purified-rosin, wherein the modified purified-rosin is a purified rosin which is modified with at least one of a fumaric acid and a maleic acid, and wherein the alcohol component comprises 1,2-propanediol and 1,3-propanediol and wherein the molar ratio of 1,2-propanediol to 1,3-propanediol (1,2-propanediol/1,3-propanediol) is 78/22 to 65/35.

17. The electrostatic image developing toner of claim 1, wherein the resin fine particle is a copolymer of styrene, methacrylic acid and sodium salt of methacrylic acid ethylene oxide adduct sulfate.

18. The two-component developer of claim 15, wherein the resin fine particle is a copolymer of styrene, methacrylic acid and sodium salt of methacrylic acid ethylene oxide adduct sulfate.

19. The process cartridge of claim 16, wherein the resin fine particle is a copolymer of styrene, methacrylic acid and sodium salt of methacrylic acid ethylene oxide adduct sulfate.

* * * * *